US005949894A

United States Patent [19]

Nelson et al.

[11] Patent Number: 5,949,894

[45] Date of Patent: Sep. 7, 1999

[54] ADAPTIVE AUDIO SYSTEMS AND SOUND REPRODUCTION SYSTEMS

[75] Inventors: Philip Arthur Nelson; Felipe Orduña-Bustamante, both of Southampton, United Kingdom; Hareo Hamada, Tokyo, Japan

[73] Assignee: Adaptive Audio Limited, United Kingdom

[21] Appl. No.: 08/820,518

[22] Filed: Mar. 18, 1997

Related U.S. Application Data

[63] Continuation-in-part of application No. 08/367,116, filed as application No. PCT/GB93/01402, Jul. 5, 1993, abandoned.

[51] Int. Cl.[6] ..... H04R 5/00

[52] U.S. Cl. ..... 381/300; 381/310; 381/17

[58] Field of Search ..... 381/1, 17–19, 381/24–26, 86, 300, 309, 310–311; 364/724.12, 724.16, 724.17, 724.19, 724.2

[56] References Cited

U.S. PATENT DOCUMENTS 5,050,119 9/1991 Lish ..... 364/724.16

5,343,522 8/1994 Yatrou et al. ..... 379/410

5,727,066 3/1998 Elliott et al. ..... 381/1

*Primary Examiner*—Curtis A. Kuntz

*Assistant Examiner*—Duc Nguyen

*Attorney, Agent, or Firm*—Christensen O'Connor Johnson & Kindness PLLC

[57] ABSTRACT

A sound reproduction system comprises a plurality of loudspeakers (S1, S2) spaced from a listener at a location (M1, M2), and a loudspeaker drive means (H) for driving the loudspeakers (S1, S2) in response to a plurality of channels of a sound recording (x) of the type being suitable for playing normally through a plurality of reference speakers that are optimally positioned at locations that are displaced from the actual positions of the loudspeakers (S1, S2). The loudspeaker drive includes a filter (H), having a filter characteristic selected by minimising the difference between a desired sound field that would be created by playing the unfiltered sound recording (x) through the reference speakers and sound field reproduced at the listener location (M1, M2) by playing the recording through the speakers (S1, S2). This results in creating a local sound field at the listener location (M1, M2) which is substantially equivalent to the local field that would result from playing the unfiltered sound recording (x) through the reference speakers.

7 Claims, 17 Drawing Sheets

(b)

(a)

ADAPTIVE AUDIO SYSTEMS AND SOUND REPRODUCTION SYSTEMS

This is a continuation-in-part of U.S. patent application Ser. No. 08/367,116, filed Jan. 5, 1995, now abandoned, which was the National stage of International application No. PCT/GB93/01402, filed Jul. 5, 1993, the benefit of the filing date of which is hereby claimed under 35 U.S.C. § 120.

BACKGROUND OF THE INVENTION

This invention relates to adaptive audio systems, and to sound reproduction systems incorporating multi-channel signal processing techniques.

SUMMARY OF THE INVENTION

Broadly speaking, the first three aspects of the invention are concerned with sound reproduction systems arranged to generate 'virtual source locations' of sound at positions other than those of actual loudspeakers employed to reproduce a sound field.

According to one aspect of the present invention a sound reproduction system comprises a plurality of loudspeakers which are arranged asymmetrically with respect to a listener location, the loudspeakers being driven through a filter means by a plurality of channels of a sound recording, the filter characteristics of the filter means being so chosen as to create at the listener location a local sound field which is substantially equivalent to the local field that would result from playing the sound recording through a plurality of loudspeakers driven without filters and positioned at virtual source locations that are substantially symmetrically positioned with respect to the listener location.

Thus, the filter means is arranged to compensate for the asymmetric positioning of the loudspeakers with respect to the listener location.

For example, with reference to FIG. 1, a transfer function matrix C(z) of electroacoustic transfer functions relates loudspeaker inputs Y to the outputs Z of microphones placed at the location of the listener ears in the sound field. A matrix H(z) of inverse digital filters can be used to process conventional two-channel stereophonic recorded signals x prior to transmission by the loudspeakers in order to produce the desired effect, as specified by a filter matrix A(z) at microphones placed in a sound field. Filter matrix A(z) is the transfer function matrix relating the recorded signals x to the signals d that are desired to be reproduced at the microphones, e denotes error signals used to adjust the digital filter matrix H(z). The matrix A(z) in accordance with the first aspect of the invention is selected by assuming that we have the said specified virtual source locations.

Operation of the filters designed in accordance with the present invention preferably ensure that the time histories of the signals produced at the listeners ears are a very close replica of the time histories that would be produced by loudspeakers at virtual source locations.

According to a second aspect of the present invention a sound reproduction system comprises at least two loudspeakers which are driven through a filter means by at least two channels of a sound recording, the filter characteristics of the filter means being so chosen as to create at the listener location a local sound field which is substantially equivalent to the local field that would result from playing the sound recording through the loudspeakers driven without filters and positioned at virtual source locations that are more widely spaced from one another than the actual spacing of the loudspeakers.

Thus the filter means is arranged to create an impression at the listener location that the loudspeakers are more widely spaced than is actually the case.

According to a third aspect of the present invention a sound reproduction system comprises four loudspeakers which are arranged at spaced-apart positions to create a sound field, first and second predetermined listener locations within the sound field, the loudspeakers being driven through filter means by two channels of a sound recording, the filter characteristics being so chosen as to create at both the first and second listener locations a respective local portion of the sound field which is substantially the same as the sound field portion that would be produced at that respective location by playing the unfiltered channels of the sound recording through a pair of loudspeakers positioned symmetrically with respect to the respective location.

A fourth aspect of the invention is concerned with an adaptive audio system and to a method of updating the filter coefficients of the adaptive filter of the system.

According to the fourth aspect of the present invention an adaptive audio system comprises an adaptive filter having a plurality of alterable filter coefficients, a processor implementing an algorithm which cyclically performs in turn a filtering operation utilising the filter, and a filter updating operation to update the filter coefficients, in which the algorithm is arranged in a cycle thereof to adjust (if necessary) only a limited number of the filter coefficients before performing a filtering operation.

This aspect of the invention enables the use of a filter with a relatively large number of coefficients whilst facilitating a high sampling rate.

Preferably only one coefficient of the filter is adjusted in each cycle.

The algorithm is preferably the LMS algorithm [2] or the filtered-x LMS algorithm [3]. In the latter case, the filtered reference signal employed can be calculated on a single-tap basis.

It is shown hereafter that the sparse update implementation method of the fourth aspect of the invention reduces the operation count by a factor of 2 in the case of the LMS algorithm and by a factor of 3 in the case of the filtered-x LMS algorithm. More importantly, the bulk of the computational work that remains to be done is mainly related to the actual filtering operation. These calculations can be performed by a dedicated filtering unit external to the main processor and then most of the processing time can be dedicated to update the filter. This technique can be easily extended to complex systems based on a number of adaptive filters having arbitrary lengths. This is an ability which is highly desirable in multi-channel applications, such as those of the first, second or third aspects of the invention.

INTRODUCTION

Digital filters can be used to operate on recorded signals prior to their transmission via loudspeakers in order to enhance the reproduction of those signals. In the simplest case, an inverse filter can be designed in order to compensate for deficiencies in a loudspeaker/room frequency response. Such a filter can be designed to produce a transfer function between the filter input and the sound pressure at a point in the sound field which has a "flat" magnitude response and a linear phase response; in time domain terms, an impulse applied to the input can be "almost perfectly" reproduced (at a little time later) at the output. The purpose of the work presented here however, is to demonstrate that this principle can be extended to the multi-channel case and to illustrate the considerable potential for the use of multi-channel inverse filters in the reproduction of sound. In Section 1, the background to the filter design problem is reviewed briefly before the solution to the multi-channel problem is presented. The filter design problem falls naturally into a least squares framework, even though filters designed with a least squares objective may not ultimately provide the best psychoacoustical benefits. The basis of the filter design technique assumes that measurements can be made in the reproduced sound field in order to compare the reproduced signals with the signals that are desired to be reproduced. The fact that the filters can therefore be designed adaptively opens up the possibility of tailoring the individual filters to the requirements of a particular listening space. However, the filters do not necessarily have to be adaptive and modified to accommodate changes in listening room acoustics; the design process can equally well be used in order to establish fixed filters used, for example to modify the position of stereophonic images in an in-car entertainment system. It is the latter topic that we address in Section 2, where computer simulations are presented which demonstrate some interesting possibilities. In particular, it is shown that a matrix of inverse filters can be used to provide "virtual source" locations at positions other than those of the actual loudspeakers. Furthermore, the possibility is examined of providing multiple "ideal listening positions"; it is demonstrated that an appropriately designed filter matrix can be used to operate on the two channels of a stereophonic recording in order to closely reproduce these signals at two pairs of points in the reproduced field. The ultimate test of these possibilities will of course be psychoacoustical. In the meantime however, attention will be concentrated on the physical aspects of the problem.

1. MULTI-CHANNEL INVERSE FILTERING USING A LEAST SQUARES FORMULATION

1.1 Background to Least Squares Filter Design

The design of digital filters for single channel equalisation is most readily approached using traditional "least squares" methods. This technique has its roots in the classical approach of Wiener [1] in which the impulse response of a filter is constrained to be causal and designed in order to minimise the time averaged squared error between the filter output and the "desired" filter output. The governing equations which have to be satisfied to ensure an optimal design are easier to handle when working in discrete (rather than continuous) time and the least squares method has become a standard technique in digital filter design. Furthermore, the LMS algorithm of Widrow and Hoff [2] provides an efficient numerical technique for rapidly adapting the coefficients of an FIR digital filter to provide the optimal impulse response. In acoustics, this algorithm requires a further modification before it can be utilised. In the loudspeaker equalisation problem, for example, the output from the filter to be designed passes through the electroacoustic path between the loudspeaker input and the point in space at which equalisation is sought. This additional transfer function has to be accounted for when using the LMS algorithm and the appropriately modified version has become known as the "filtered-x" LMS algorithm as described by Widrow and Stearns [3]. The algorithm was first proposed by Morgan [4] and independently for use in feedforward control by Widrow [5] and for the active control of sound by Burgess [6]. In many problems involving the active control of sound and vibration it is often necessary to use multiple inputs and to ensure that the control filters are designed to ensure the minimisation of some appropriate measure of error at multiple points in space [7]. This requirement led Elliott and Nelson [8] to generalise the filtered-x LMS algorithm to deal with multiple errors. The resulting algorithm has become known as the Multiple Error LMS algorithm [9] and it has been extensively utilised in a variety of applications involving the active control of sound and vibration (see Nelson and Elliott [10] for a full account).

The Multiple Error LMS algorithm has been still further generalised and specifically applied to problems in audio system equalisation by Nelson et al [11, 12]. In that work, the formulation of the problem was generalised to incorporate multiple input signals. This is the case found in stereophonic reproduction for example, where the algorithm has since been applied with considerable success [13]. The general formulation of the least squares filter design problem will again be presented here before describing further potential applications of the technique to the reproduction of sound.

1.2 Solution of the Multi-Channel Problem

The multi-channel problem is illustrated in block diagram form in FIG. 1. Working in discrete time, we have K recorded signals $x_k(n)$ comprising the vector x(n). These are transmitted via M loudspeaker channels whose inputs are given by $y_m(n)$ which are the elements of the vector y(n). The resulting signals are transmitted via a matrix C(z) of electroacoustic transfer functions and detected by L microphones whose outputs are given by $Z_L(n)$, these being the elements of the vector z(n). We introduce a K×M matrix H(z) of FIR digital filters which operates on the K recorded signals prior to transmission via the M loudspeakers. The coefficients of the filters in the matrix are designed in order to minimise the weighted sum of the mean squared values of the error signals $e_l(n)$. The l'th error signal is defined as the difference between the desired signal $d_l(n)$ and the reproduced signal $z_l(n)$. The desired signals $d_l(n)$ (comprising the vector d(n)) are in turn specified by passing the recorded signals $x_k(n)$ through a K×L matrix A(z) of filters. The filter matrix A(z) thus specifies the desired signals. Whilst this is the most general method of specifying the desired signals, the elements of A(z) will in general include appropriate "modelling delays" such that the desired signals are in some sense delayed versions of the recorded signals. This is clearly necessary if reductions in mean squared error are to be achieved when the elements of C(z) are non-minimum phase. The way in which A(z) may be specified will become clearer in the next section.

The problem of finding the optimal coefficients of the filters in H(z) will now be addressed. As in the single channel case when developing the filtered-x LMS algorithm, the analysis is greatly assisted by effective reversal of operation of the transfer functions H(z) and C(z). This leads to the definition of the "filtered reference signals" $r_{lmk}(n)$ which are the signals produced by passing k'th recorded signal through the l,m th element of the matrix C(z). Thus the signal $z_l(n)$ can be expressed as $$z_l(n) = \sum_{k=1}^{K} \sum_{m=1}^{M} \sum_{i=0}^{l-1} h_{mk}(i) r_{lmk}(n-i) \tag{1}$$

where $h_{mk}(i)$ is the i'th coefficient of the FIR filter whose input is the k'th recorded signal and whose output is the input to the m'th loudspeaker. Each filter is assumed to have an impulse response of I samples in duration. In vector notation we can write equation (1) as $$z_l(n)=h^T(o)r_l(n)+h^T(1)r_l(n-1)\ldots h^T(I-1)r_l(n-I+1) \tag{2}$$

where we have defined a composite tap weight vector and a reference signal vector respectively by $$h^T(i)=[h_{11}(i)\ h_{21}(i)\ldots h_{M1}(i)|h_{12}(i)h_{22}(i)\ldots h_{M2}(i)|h_{1K}(i)H_{2K}(i)\ldots h_{MK}(i)] \tag{3}$$

$$r_l^T(n)=[r_{l11}(n)r_{l21}(n)\ldots r_{lm1}(n)|r_{l12}(n)r_{l22}(n)\ldots r_{lM2}(n)|r_{l1K}(n)r_{l2K}(n)\ldots r_{lMK}(n)] \tag{4}$$

A further composite tap weight vector can be defined which consists of all the I tap weights of all the L×M filters. Thus is given by $$w^T=[h^T(o)h^T(1)\ldots h^T(I-1)] \tag{5}$$

The L'th order vector of error signals can now be written as $$e(n)=R(n)w-d(n) \tag{6}$$

where the matrix R(n) of filtered reference signals is given by $$R(n)=\begin{bmatrix} r_1^T(n)r_1^T(n-1)\ldots r_1^T(n-I+1) \\ r_2^T(n)r_2^T(n-1)\ldots r_2^T(n-I+1) \\ \\ r_L^T(n)r_L^T(n-1)\ldots r_L^T(n-I+1) \end{bmatrix} \tag{7}$$

With the vector of error signals defined by equation (6), we can now proceed to determine the optimal value of the composite tap weight vector w which minimises the sum of the squared error signals. Here we will generalise the problem somewhat by minimising a cost function which allows for differential weighting of the squared errors (which may be important in some applications) and also penalises the "effort" used in arriving at the optimal solution. The latter strategy may prove useful in the event of the problem becoming ill-conditioned, where little reduction in error is achieved at the expense of large values of the filter coefficients. Thus we define a cost function given by $$J=E[e^T(n)W_e e(n)+w^T(n)W_w w(n)] \tag{8}$$

where $W_e$ and $W_w$ are (generally diagonal) weighting matrices and E[ ] denotes the expectation operator. The minimum of this quadratic function can be found by first substituting the expression for e(n) given by equation (6) and then setting the gradient of J with respect to w equal to zero. Thus assuming $W_e$ is symmetric, J can be written as $$J=E[d^T(n)W_e d(n)-2w^T R^T(n)W_e d(n)+w^T(R^T(n)W_e R(n)+W_w)w] \tag{9}$$

The gradient of J with respect to w, also assuming that $W_w$ is symmetric, can be written as $$\frac{\partial J}{\partial w}=2E\,[(R^T(n)W_e R(n)+W_\omega)w-R^T(n)W_e d(n)] \tag{10}$$

Thus the solution that ensures that ∂j/∂w is zero is given by the optimal tap weight vector $$w_o=\{E[R^T(n)W_e R(n)+W_w]\}^{-1}\{E[R^T(n)W_e d(n)]\} \tag{11}$$

The corresponding minimum value of J is given by $$J_o=E[d^T(n)W_e d(n)]-E[d^T(n)W_e R(n)]w_o \tag{12}$$

The optimal tap weight vector $w_o$ can clearly be found by inversion of the matrix $E[R^T(n)\,W_e R(n)+W_w]$ which must be positive definite for a unique minimum to exist. In the case when $W_e$=I (the identity matrix) and $W_w$=0, this matrix has a block Toeplitz structure and efficient numerical schemes exist for its inversion [14]. The other approach is to use the Multiple Error LMS algorithm. This has its origin in the method of steepest descent in which the minimum of the function is found iteratively by updating the coefficient vector w by an amount proportional to the negative of the gradient of the function. First note that using equation (6) in equation (10) allows the gradient to be written as $$\frac{\partial J}{\partial w}=2E\,[R^T(n)W_e e(n)+W_\omega w] \tag{13}$$

Following Widrow and Hoff [2], we now make the assumption that the filter coefficients are updated by an instantaneous estimate of this gradient, which is given by dropping the expectation operator in equation (13). Thus the tap weight update equation becomes $$w(n+1)=w(n)-\alpha W_w w(n)-\alpha R^T(n)W_e e(n) \tag{14}$$

where αis a convergence coefficient. Equation (14) thus specifies a simple and readily implemented algorithm for iteratively converging to the solution for the optimal coefficient vector. As pointed out by Elliott et al [9], the effect of the "effort" weighting $W_w$ can be shown to be equivalent to the "leaky" LMS algorithm in which case in the absence of an error term e(n), the coefficient vector w would decay away to zero. Note that the implementation of the algorithm requires the generation of the filtered reference signals $r_{lmk}(n)$ which comprise the elements of the matrix R(n). These can be generated by passing the recorded signals $x_k(n)$ through FIR filters which give an estimate of the transfer function $C_{lm}(z)$. These in turn can be identified by using a broadband training signal passed through the m'th loudspeaker to the l'th microphone with the LMS algorithm used to adapt the filter coefficients.

1.3 Relationship of the Least Squares Solution to Methods for Finding Exact Inverse Filters An alternative approach to inverse filtering in room acoustics is that proposed by Myoshi and Kaneda [15] in the form of the Multiple-Input/Output Inverse Filtering Theorem (MINT). In that work, it is demonstrated that a pair of filters can be designed which can be used on the inputs to two loudspeakers which are both used to transmit a given recorded signal to a specific point in space. The filters can be designed to ensure that "perfect" equalisation of the transmission path is produced, even when the transmission paths between the loudspeaker inputs and the point where equalisation is required are non-minimum phase (after an appropriate bulk delay has been subtracted; a point which is not altogether clear from Myoshi and Kaneda's paper [15]). An analysis of the relationship between MINT and the least squares approach presented above has been presented by Nelson et al [16]. This leads to a useful result which may have some bearing on the choice of the values of K, M and L in a given application, together with number of coefficients I used in the inverse filters.

It is assumed at the outset that the transmission paths $C_{lm}(z)$ can be adequately represented by FIR filters having J coefficients. It can then be shown that to produce exact equalisation of the transmission channels from K recorded signals to L=K points in space requires that the number of coefficients in the inverse filters is given by $$I=(J-1)\left(\frac{L}{M-L}\right) \tag{15}$$

The full derivation leading to this result is presented in reference [16]. However, it should again be emphasised that the choice of I given by equation (15) ensures the exact equalisation of the J-coefficient FIR filters representing the transmission paths $C_{lm}(z)$; equalisation of the real transmission paths therefore assumes that all these paths are exactly represented by J-coefficient filters. Nevertheless, the analysis presented in reference [16] gives some indication of the number of coefficients I required in the inverse filters and demonstrates furthermore that in order to realise an exact inverse, it is required that M>L (i.e. a greater number of loudspeakers is required than the number of points at which equalisation is attempted). This result is therefore consistent with the work of Myoshi and Kaneda [15] who show, for example, in the case M=2, L=1, that I=(J−1). The work presented in reference [16] generalises Myoshi and Kaneda's result and also suggests that the Multiple Error LMS algorithm can be used to find the required solution for the coefficients of the inverse filters.

2. POTENTIAL APPLICATIONS OF MULTI-CHANNEL TECHNIQUES

IN THE IMPROVEMENT OF SOUND REPRODUCTION SYSTEMS

Figure 1:
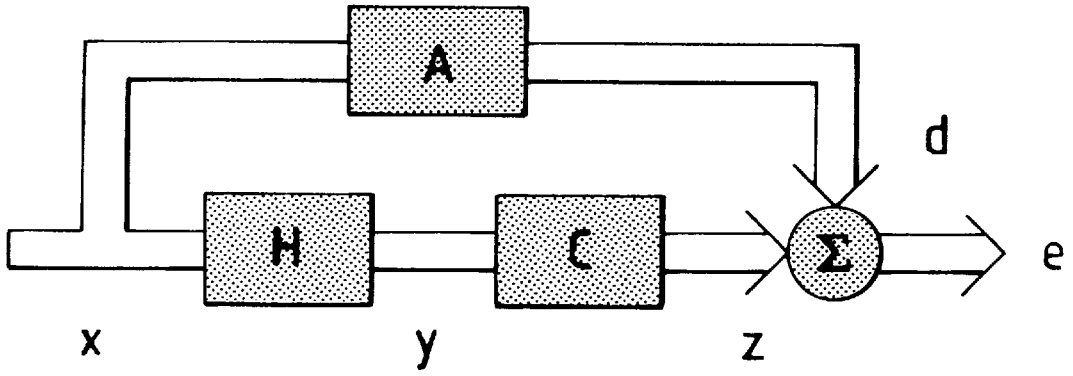
FIG. 1 is a block diagram for the analysis of multi-channel inverse filtering problems in sound reproduction.

2.1 The use of Multiple Errors in Single Channel Response Equalisation

Of course the simplest equalisation problem corresponds to the case where an inverse filter is introduced on the inout to a loudspeaker and the filter is designed to ensure that the signal reproduced at a point in space is as near as possible (in the least squares sense) to a delayed version of the input signal. A simple example of such an approach is that presented by Kuriyama and Furukawa [17] who use the single channel filtered-x LMS algorithm to design a filter for the equalisation of the on-axis response of a three-driver loudspeaker system (including cross-over networks). A 512 coefficient FIR filter operating at a sample rate of 32 kHz succeeded in producing a flat amplitude and linear phase response between 200 Hz and 12 kHz. No results were reported however, of measurements of the response of the system at spatial positions other than those at which equalisation was achieved. This is a crucial issue in response equalisation problems; the effect of the equalising filter on the global performance of the system. This problem has been addressed by Wilson [18] in the context of loudspeaker equalisation. It was demonstrated that minimising a weighted sum of squared errors derived from measurements of both on- and off-axis responses was successful in improving the off-axis response also, albeit at the expense of the improvements in on-axis response. Similar comments apply to room response equalisation. Farnsworth et al [19], for example, used computer simulations of an enclosed sound field to investigate the effect of equalising the transmission response to one point in a room on the responses at other points in the room. The results predicted a potentially severe degradation of response outside a zone surrounding the equalisation points. The subjective response to this effect, however, has yet to be quantified. An attempt to ensure "global equalisation" was made by Elliott and Nelson [20] who also used computer simulations to study the equalisation of the low frequency acoustic field in a car interior. In that case, multiple errors were again minimised, with the desired signals being specified at a number of points in the sound field. These desired signals were delayed versions of the input signal with the delays chosen to be equal to the acoustic propagation delays from the simulated loudspeaker source to the points at which the desired signals were specified. This strategy predicted "global equalisation" in the sense that the frequency response was improved at all the equalisation points, but of course was not made perfect at any one point.

The operation of the filters designed in accordance with the present invention preferably ensure that the time histories of the signals produced at the listeners ears are a very close replica of the time histories that would be produced by loudspeakers at virtual source locations.

2.2 Response Equalisation in Stereophonic Reproduction

Rather than attempting (the unrealisable) goal of perfect global equalisation of a single channel system (which is then subsequently used in a stereophonic reproduction system), a more realistic approach may be to accept from the outset that good equalisation may be achieved in restricted spatial zones and then to design equalisation systems that make maximum use of this capability. Also accepting that modern sound reproduction systems almost exclusively involve the transmission of two channels of recorded signal leads to some further specific applications of equalisation techniques. One such application is described in detail by Nelson et al [13] where a 2×2 matrix of filters H(z) was used to process two recorded signals prior to transmission via two loudspeakers. The desired signals were specified at two points in space, these being at the location of the ears of a human listener. These desired signals were specified as simply delayed versions of the "left" and "right" channels respectively. Thus once the equalisation filters had been adapted, the left ear of the listener would perceive only the recorded signal from the left channel and the right ear would perceive only the recorded signal from the right channel. The inverse filter was thus effective in cancelling the "cross-talk" between left loudspeaker and right ear and vice-versa, in addition to equalising the frequency responses of both loudspeakers. As such, the system represents a digital implementation of the system suggested by Atal and Schroeder [21], the impressive subjective capabilities of the original analogue implementation being graphically described by Schroeder [22]. Such a system is well suited to the reproduction of binaurally recorded sound fields, such as those recorded with the use of an artificial head.

However, most modern recordings do not use such techniques and the typical two-channel stereophonic recording is a carefully mixed amalgam of individual signals, with left and right channels attributed with signal components in order to maximise the effective stereophonic illusion, largely in accordance with the subjective judgements of the producer of the recording. If one accepts that such recording techniques will not readily be changed, the potential for the further exploitation of equalisation techniques becomes focussed on providing realisable improvements in existing reproduction systems. One such improvement that can be obtained in accordance with the invention is to use adaptive filters to compensate for practical deficiencies in loudspeaker location relative to a listener. In the case of in-car entertainment systems for example, it is very difficult to locate the loudspeakers symmetrically with respect to the listener and thus produce the stereophonic illusion initially perceived by the recording engineer. The same may be true of many domestic listening environments. With appropriately designed filters, however, the loudspeakers can effectively be shifted to "virtual locations" which apparently seat the listener in the optimal location.

Figure 2:
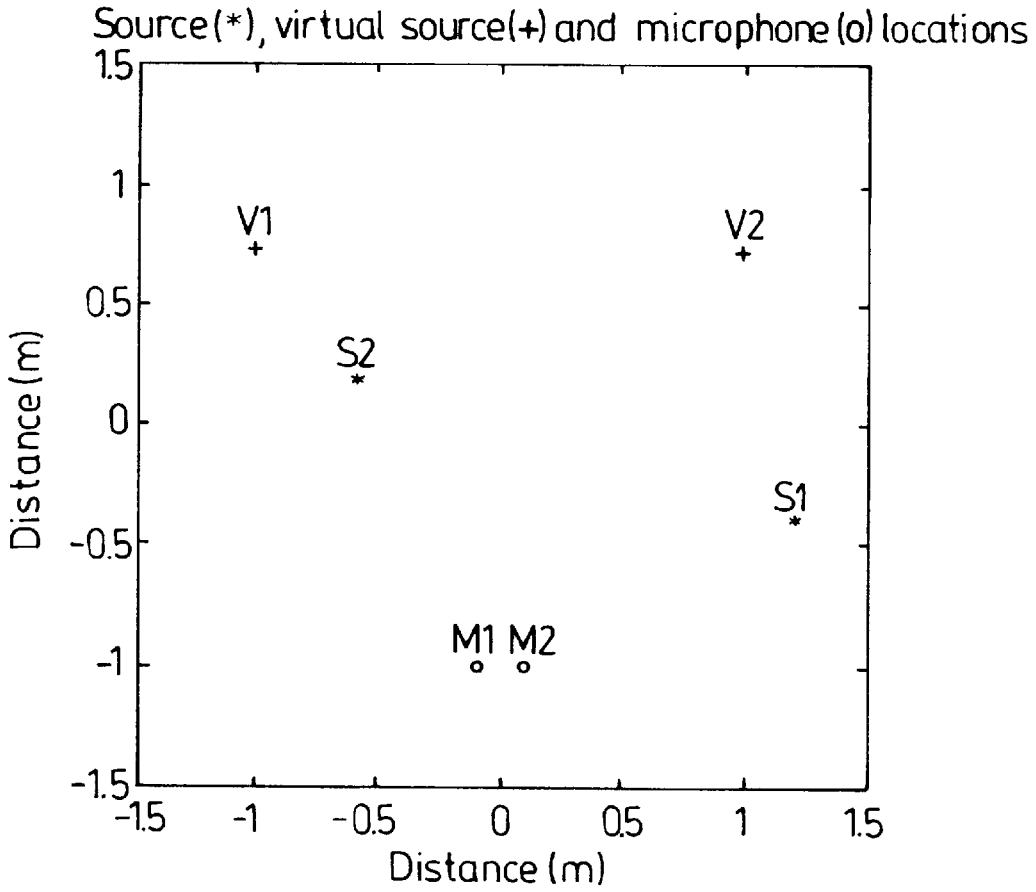
FIG. 2 shows a geometrical arrangement of real sources (S1, S2) whose outputs are prefiltered in accordance with the invention in order to produce signals at microphones (M1, M2) which appear to originate from virtual sources (V1, V2).

The geometry used in computer simulations of this approach in accordance with the first aspect of the invention is shown in FIG. 2. The matrix C(z) of FIG. 1 which relates the signals output from sources S1 and S2 (FIG. 2) to microphones M, and M2 (placed at the location of the listeners ears) is given by $$C(z) = \frac{\rho_o}{4\pi}\begin{bmatrix} \frac{z^{-\Delta_{11}}}{r_{11}} & \frac{z^{-\Delta_{12}}}{r_{12}} \\ \frac{z^{-\Delta_{21}}}{r_{21}} & \frac{z^{-\Delta_{22}}}{r_{22}} \end{bmatrix} \tag{16}$$

where these transfer functions are the digital versions of the continuous time transfer function relating the pressure at a point in space to the volume acceleration of a point monopole source. Thus the delays $\Delta_{mi}$ are given by $$\Delta_{ml=round}\,(f_s r_{ml}/c_o) \tag{17}$$

where $r_{ml}$, is the distance between the m'th source and the l'th microphone, fs is the sampling frequency and $c_o$ is the sound speed. The matrix A(z) of FIG. 1, which specifies the relationship between the recorded signals x and the desired signals d, is selected by assuming that we have certain "virtual source" locations VI and V2, as illustrated in FIG. 2. This ensures that the desired signals $d_l(n)$ and $d_2(n)$ are those that would be produced by virtual sources V1 and V2. Thus $$A(z) = \frac{\rho_o z^{-\Delta_{mod}}}{4\pi}\begin{bmatrix} \frac{z^{-\gamma_{11}}}{u_{11}} & \frac{z^{-\gamma_{12}}}{u_{12}} \\ \frac{z^{-\gamma_{21}}}{u_{21}} & \frac{z^{-\gamma_{22}}}{u_{22}} \end{bmatrix} \tag{18}$$

where $z^{-\Delta}$mod is a modelling delay and the delays $\gamma_{ml}$ are given by $$\gamma_{ml}=\text{round}(f_s u_{ml}/c_o) \tag{19}$$

where $u_{ml}$ is the distance between the m'th virtual source location and the l'th microphone. In all the simulations that follow, the sample rate $f_s$ was chosen to be 8 KHz with $C_o$=341 $ms^{-1}$ and $\rho_o$=1.0 $kg/m^3$ for simplicity. The number of coefficients I in the filter matrix H(z) was always chosen to be 128, and the filters were designed adaptively using pseudo-random sequences $x_1(n)$ and $x_2(n)$.

Figure 3:
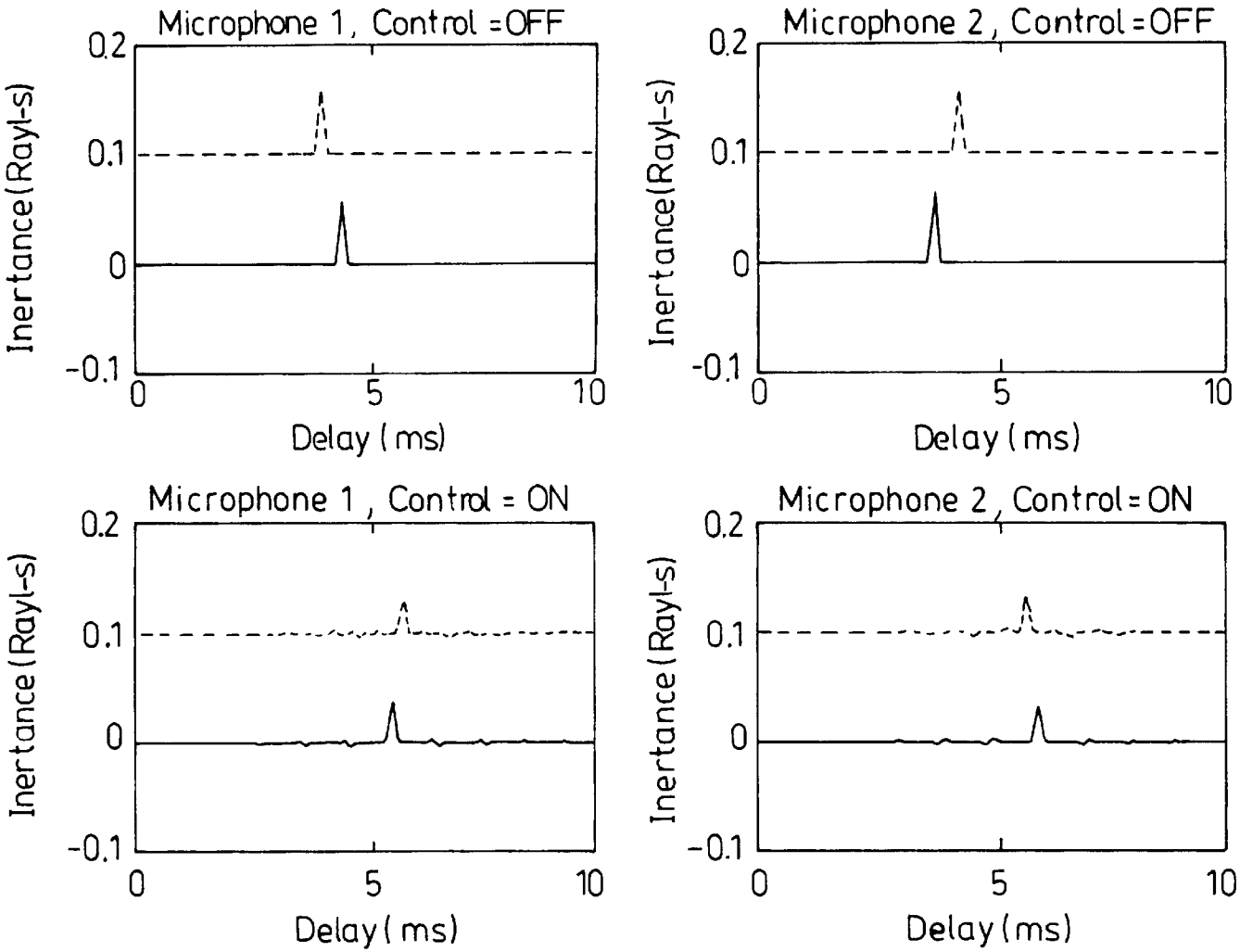
FIG. 3 shows the impulse responses from inputs $x_1$ (dashed line) and $x_2$ (solid line) to the two microphones shown in FIG. 2 before (Control=OFF) and after (Control=ON) the introduction of the filter matrix H used to pre-filter the outputs of sources S1 and S2. The relative arrival times of the impulses at the microphones are as if they originated from virtual sources V1 and V2. A modelling delay of 6.25 ms included during the simulations has been removed from the prefiltered responses (lower plots).
Figure 4:
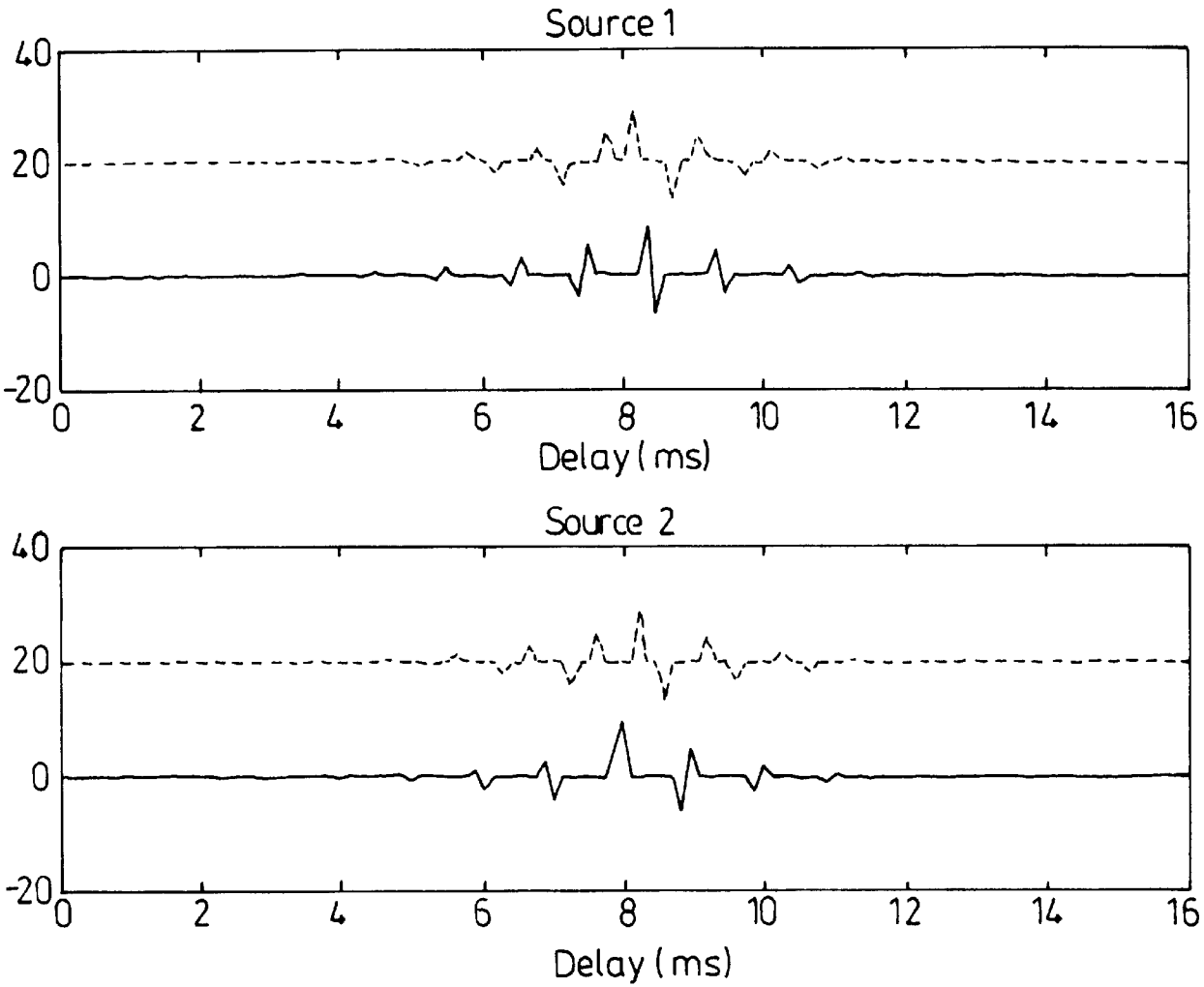
FIG. 4 shows the impulse responses of the elements of the filter matrix H designed to pre-filter the outputs of sources S1 and S2 shown in FIG. 2. The dashed lines show the impulse responses of the filters operating on input $x_1$ and the solid lines show the impulse responses of the filters operating on input $x_2$.
Figure 5:
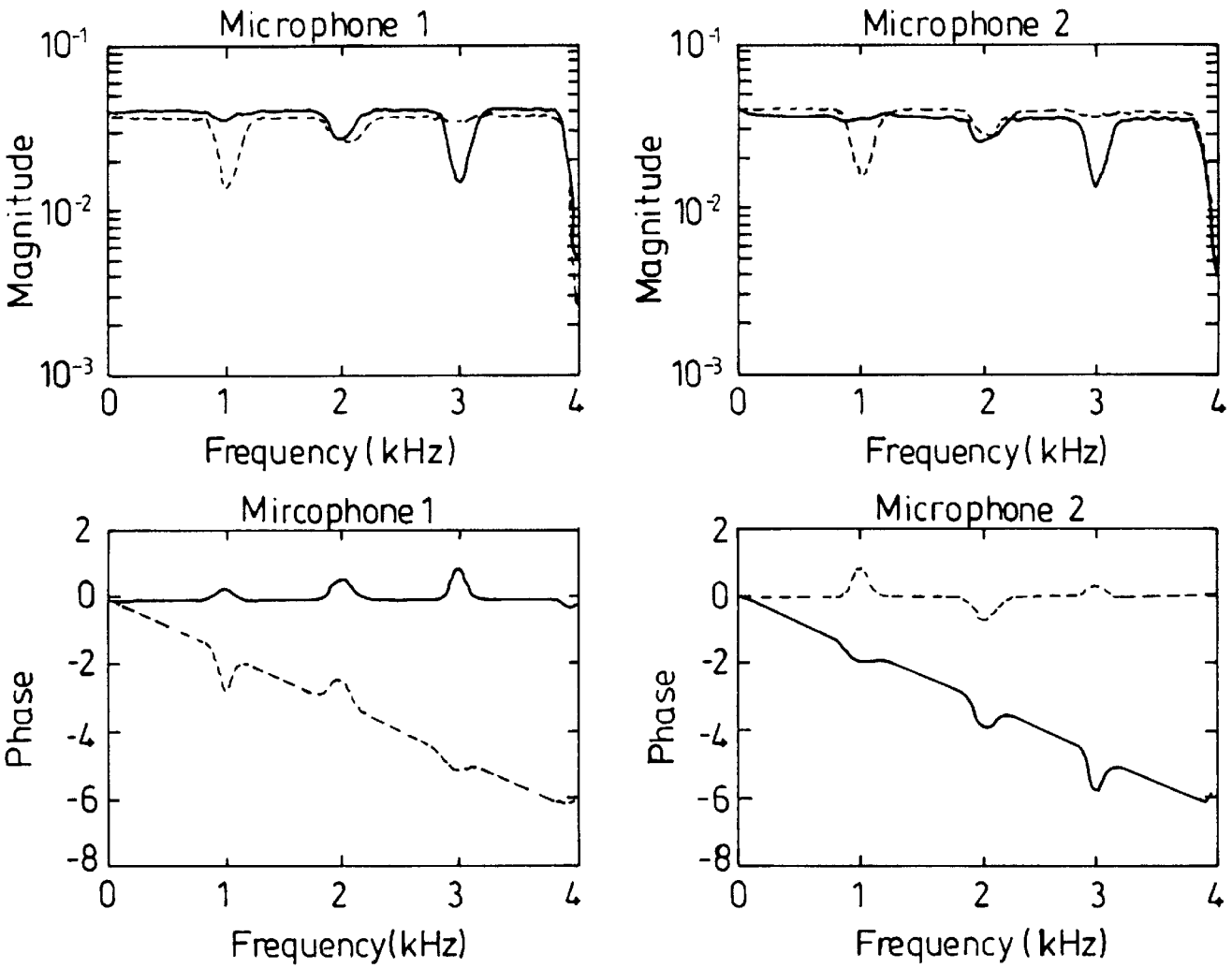
FIG. 5 shows frequency response functions associated with the composite system H(z)C(z) whose impulse response is illustrated in the lower traces of FIG. 3. The phase responses have been calculated relative to that associated with the first arrival in the time domain. Note the small difference in magnitude response and the substantial difference in phase response corresponds to that which would be expected to be produced by the virtual source locations shown in FIG. 2.

In the arrangement shown in FIG. 2, for the purposes of illustration, the sources S1 and S2 are not only placed asymmetrically with respect to V1 and V2 but are also inverted relative to VI and V2. FIG. 3 shows the resulting impulse response of the system once the filter matrix H(z) of FIG. 1 has been designed using the algorithm of equation (14) with $W_w$=0 and $W_e$=I. The corresponding filter impulse responses are illustrated in FIG. 4. The results of FIG. 3 clearly demonstrate that once signals input to S1 and S2 are prefiltered by H(z) (control=ON in the figures) the relative time of arrival of impulses input to the system become equivalent to those that would be produced by virtual sources V1 and V2. Note that for microphone 1 for example, the signal from S2 arrives after that from S1 whilst for microphone 2, the signal from 52 arrives before that from S1; a situation which reverses that observed in the unfiltered case (Control=OFF in the figure). The effectiveness of the system is also illustrated by the frequency response plots shown in FIG. 5. These in particular show how the relative phase between the signals arriving at microphones 1 and 2 indicates the difference in travel time between the virtual sources and the two microphones. Also note that the magnitude responses are consistent with the difference in distance between the virtual sources and the microphones. Of course in this simple illustration, no reverberation is included in the model and this could also be accounted for in the implementation of a real system.

Figure 6:
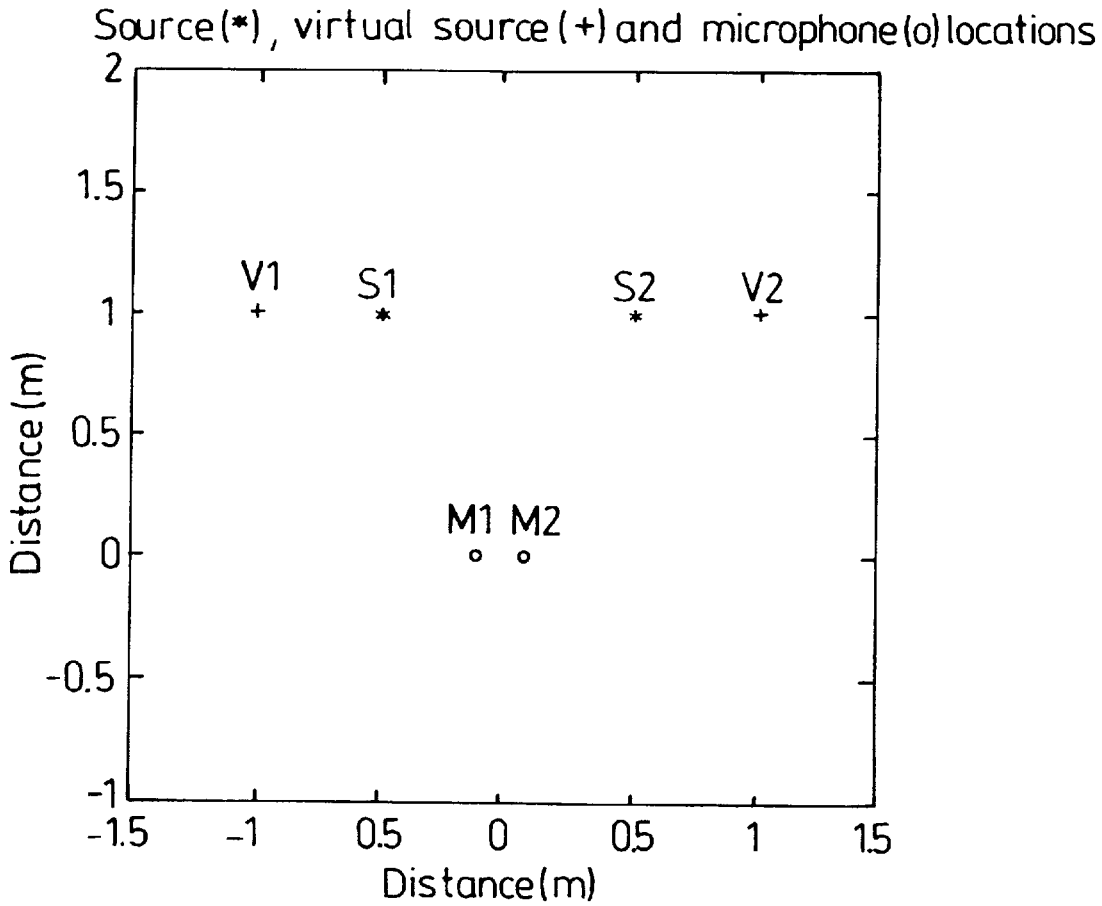
FIG. 6 shows a further geometrical arrangement of real sources (S1, S2) whose outputs are prefiltered in accordance with the invention in order to produce signals at microphones (M1, M2) which appear to originate from virtual sources (V1, V2).
Figure 7:
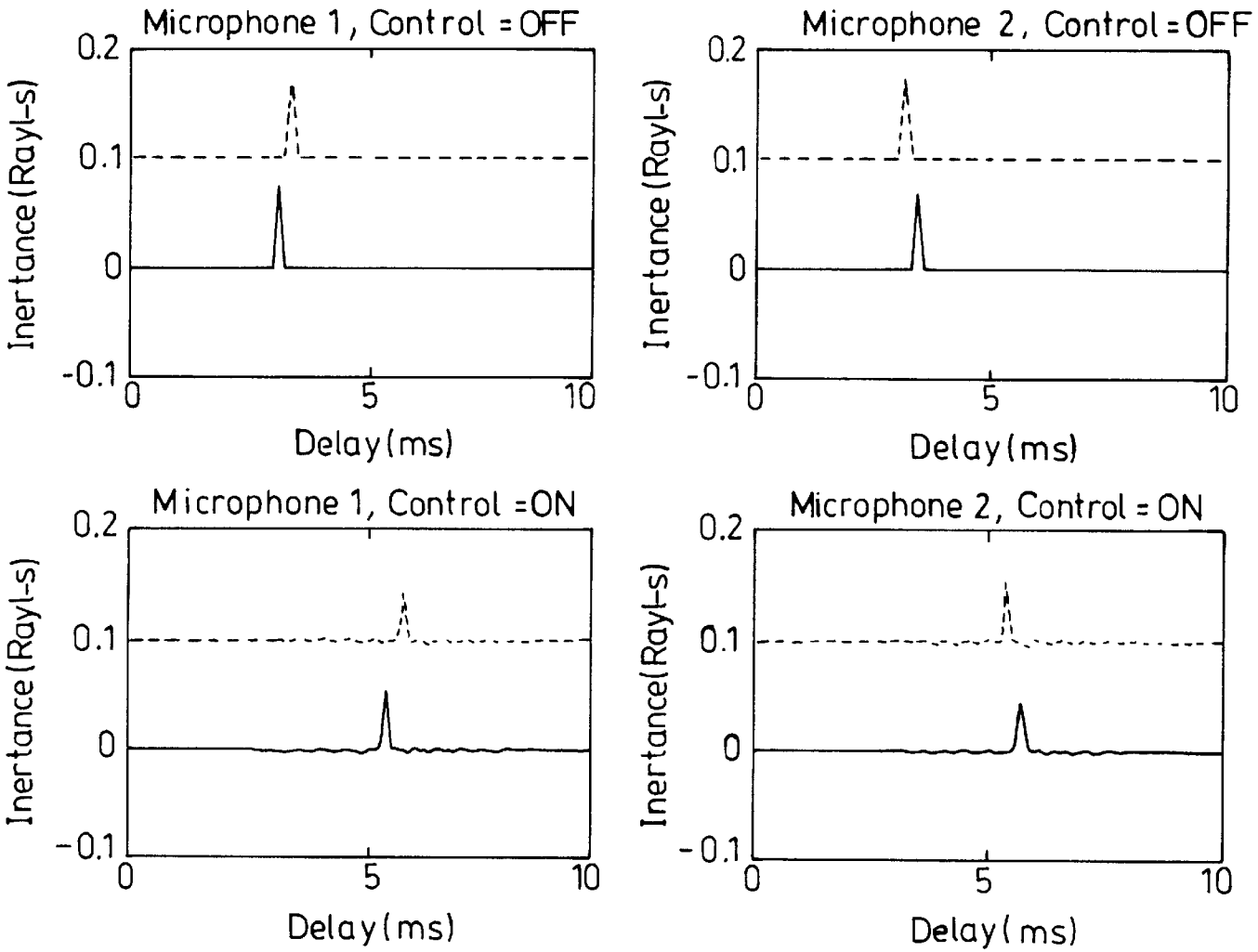
FIG. 7 shows impulse responses from inputs $x_1$ (dashed line) and $x_2$ (solid line) to the two microphones shown in FIG. 6 before (Control=OFF) and after (Control=ON) the introduction of the filter matrix H used to pre-filter the outputs of sources S1 and S2. Note the increased time between the arrivals of the impulses produced by the location of the virtual sources V1 and V2.
Figure 8:
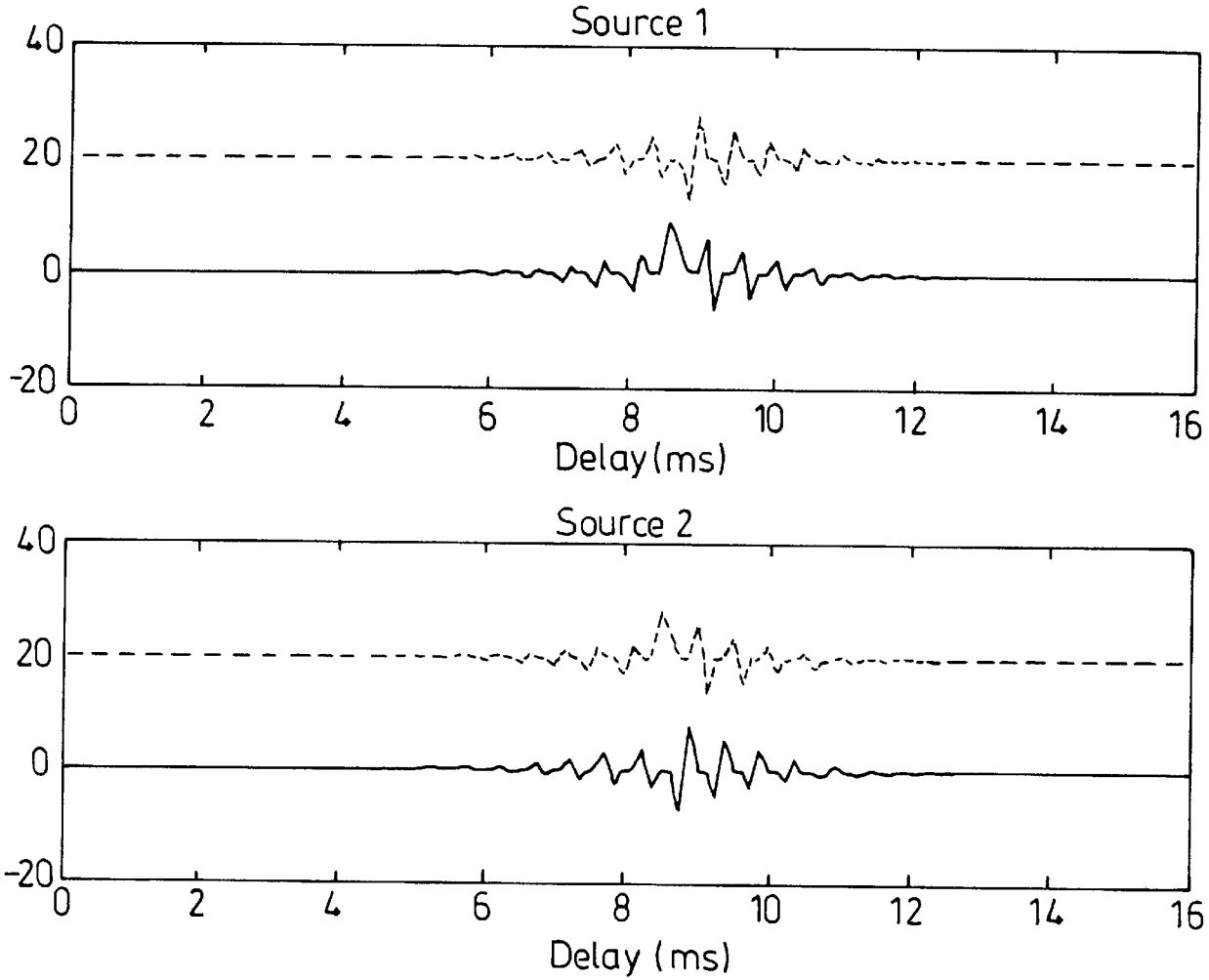
FIG. 8 shows impulse responses of the elements of the filter matrix H designed to pre-filter the outputs of sources S1 and S2 shown in FIG. 6. The dashed lines show the impulse responses of the filters operating on input $x_1$ and the solid lines show the impulse response of the filters operating on input $x_2$.
Figure 9:
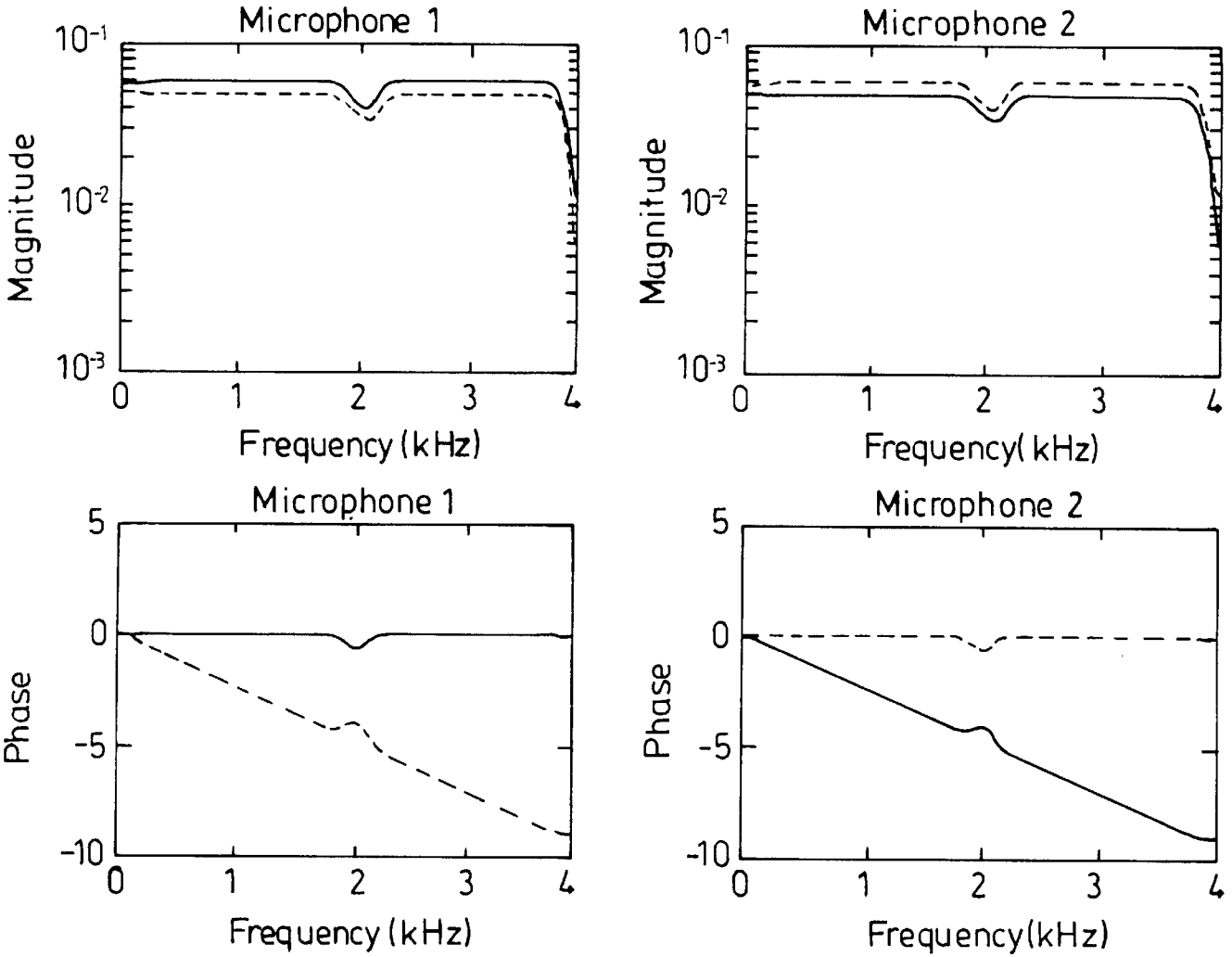
FIG. 9 shows frequency response functions associated with the composite system H(z)C(z) whose impulse response is illustrated in the lower traces of FIG. 7. The phase responses have been calculated relative to that associated with the first arrival in the time domain. Note the small difference in magnitude response and the substantial difference in phase response corresponds to that which would be expected to be produced by the virtual source locations shown in FIG. 6.

In accordance with a second aspect of the invention systems where the such a technique could also find application in listening systems where the loudspeakers for reproduction are placed close together; the virtual sources could be placed in order to effectively increase the spacing between the real sources. FIGS. 7, 8 and 9 show the results of simulations which indicate the feasibility of this approach with the geometry of the real and virtual sources illustrated in FIG. 6. FIG. 7 shows how the arrival times of impulses applied via the signals $x_1(n)$ (solid line) and $x_2(n)$ (dashed line) are made different by the presence of the filter matrix H(z). In particular, the time between arrivals at a given microphone is increased to be consistent with the location of the virtual sources. The impulse responses of the filters necessary to accomplish this are shown in FIG. 8, and FIG. 9 shows the frequency response functions of the composite system H(z)C(z). These again illustrate the magnitude and phase differences associated with the specified virtual source locations.

2.3 The Production of Multiple Stereophonic Images.

Figure 10:
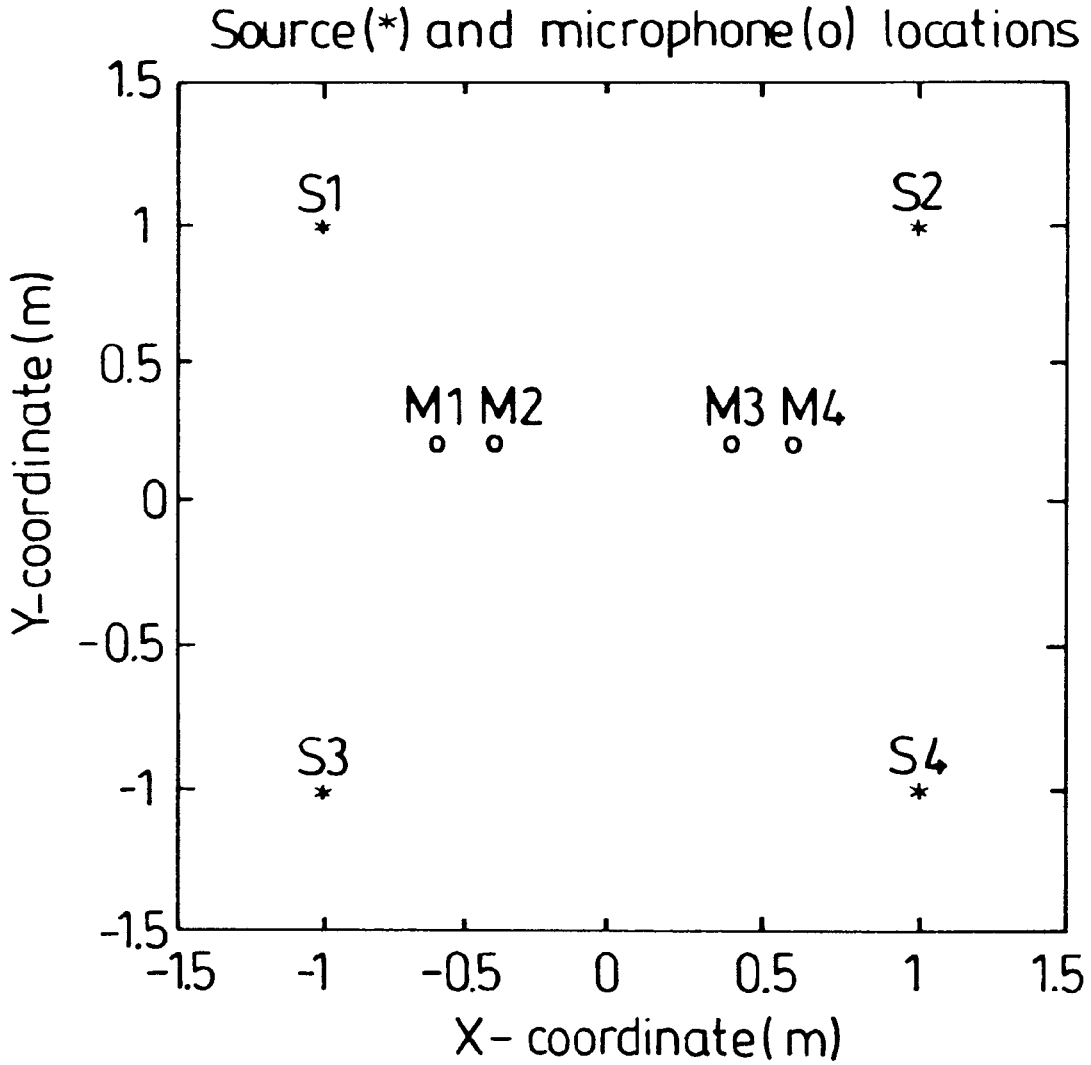
FIG. 10 shows a source and microphone layout used in simulating the production of multiple stereo images. The two signals $x_1$ and $x_2$ are filtered in accordance with the invention with a matrix H(z) prior to transmission via sources S1–S4.

In accordance with a third aspect of the invention yet another possibility that emerges from the general filter design philosophy outlined above, is that of operating on the two channels of a conventional stereophonic recording in order to produce ideal virtual source locations for two independent listening positions. Such an approach does however require the use of at least four loudspeakers. As an illustration of this possibility, here we present the results of some computer simulations (first presented by Orduna-Bustamante et al [23]) where the source/microphone arrangement of FIG. 10 is considered. Also, for the purposes of illustration, we will deal with the "cross-talk cancellation" case where, for example, we wish to reproduce two recorded signals $x_1(n)$ and $x_2(n)$ at M1 and M2 and at M3 and M4. In this case, the matrix C(z) takes the form $$C(z) = \frac{\rho_o}{4\pi}\begin{bmatrix} (z^{-\Delta_{11}}/r_{11}) & (z^{-\Delta_{12}}/r_{12}) & (z^{-\Delta_{13}}/r_{13}) & (z^{-\Delta_{14}}/r_{14}) \\ (z^{-\Delta_{21}}/r_{21}) & (z^{-\Delta_{22}}/r_{22}) & (z^{-\Delta_{23}}/r_{23}) & (z^{-\Delta_{24}}/r_{24}) \\ (z^{-\Delta_{31}}/r_{31}) & (z^{-\Delta_{32}}/r_{32}) & (z^{-\Delta_{33}}/r_{33}) & (z^{-\Delta_{34}}/r_{34}) \\ (z^{-\Delta_{41}}/r_{41}) & (z^{-\Delta_{42}}/r_{42}) & (z^{-\Delta_{43}}/r_{43}) & (z^{-\Delta_{44}}/r_{44}) \end{bmatrix} \quad (20)$$

and the matrix A(z) which defines the desired signals is given by $$A(z) = z^{-\Delta_{mod}}\begin{bmatrix} 1 & 0 \\ 0 & 1 \\ 1 & 0 \\ 0 & 1 \end{bmatrix} \quad (21)$$

where $\Delta_{mod}$ is a modelling delay. In the simulations presented here, the 4×2 matrix H(z) was comprised of eight FIR filters each having a number of coefficients I=128. The modelling delay $\Delta_{mod}$ was chosen to be 96 samples.

Figure 11:
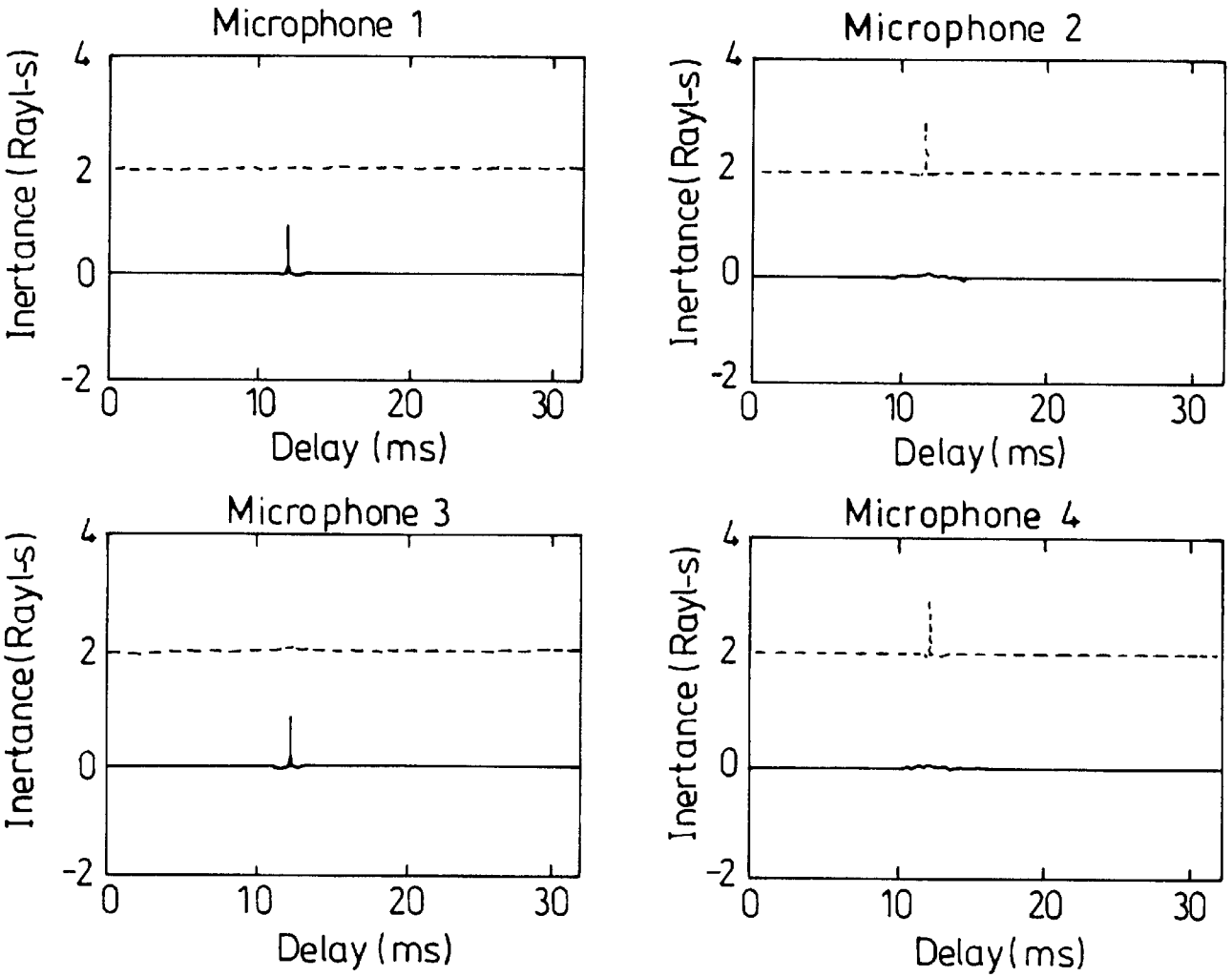
FIG. 11 shows impulse responses of the composite system H(z)C(z) for inputs $x_1$ (solid line) and $x_2$ (dashed line) when H(z) is designed to ensure that $x_1$ is reproduced at microphones M1 and M3 and that $x_2$ is reproduced at microphones M2 and M4 (see FIG. 10).
Figure 12:
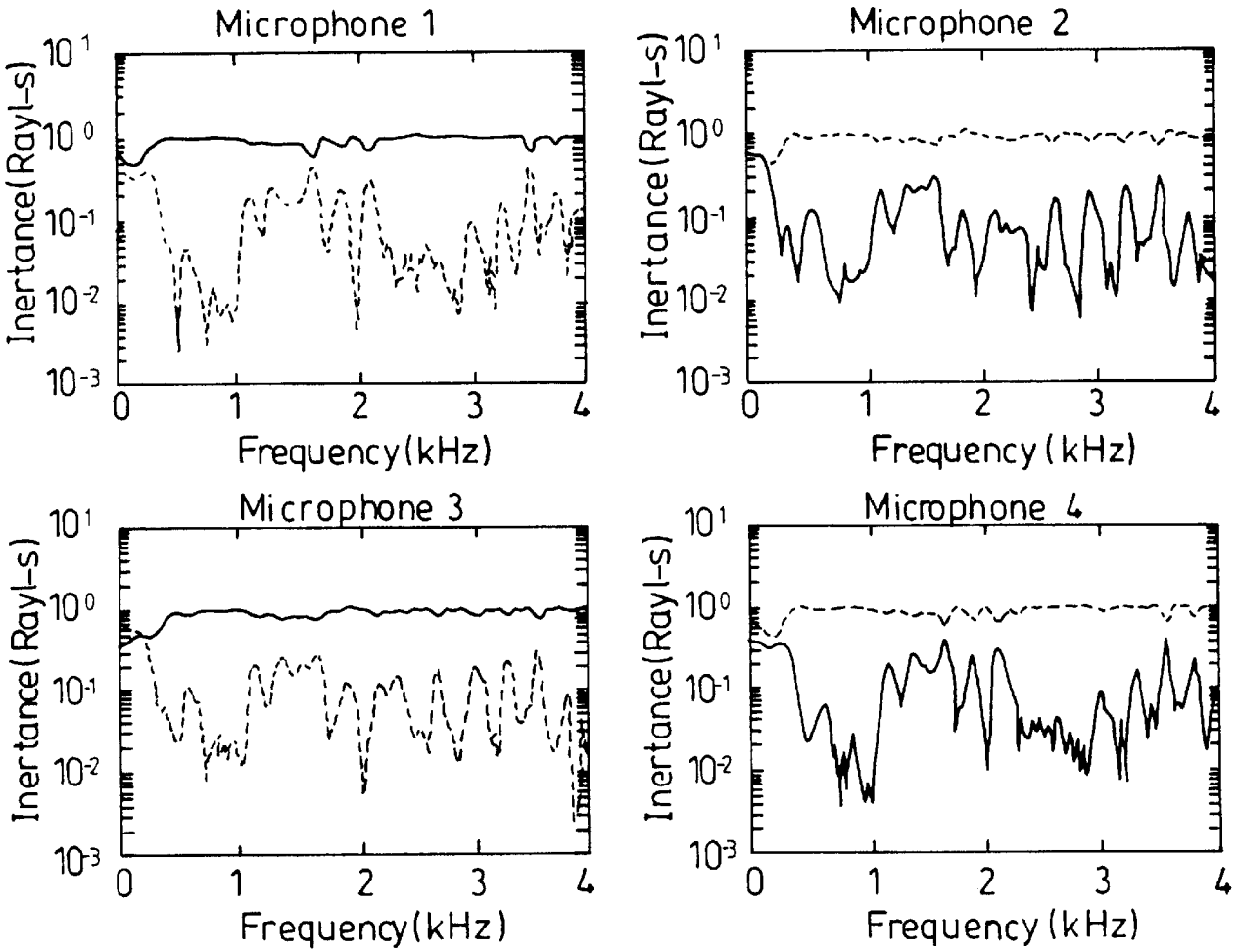
FIG. 12 shows frequency response functions corresponding to the impulse responses of FIG. 11.
Figure 13:
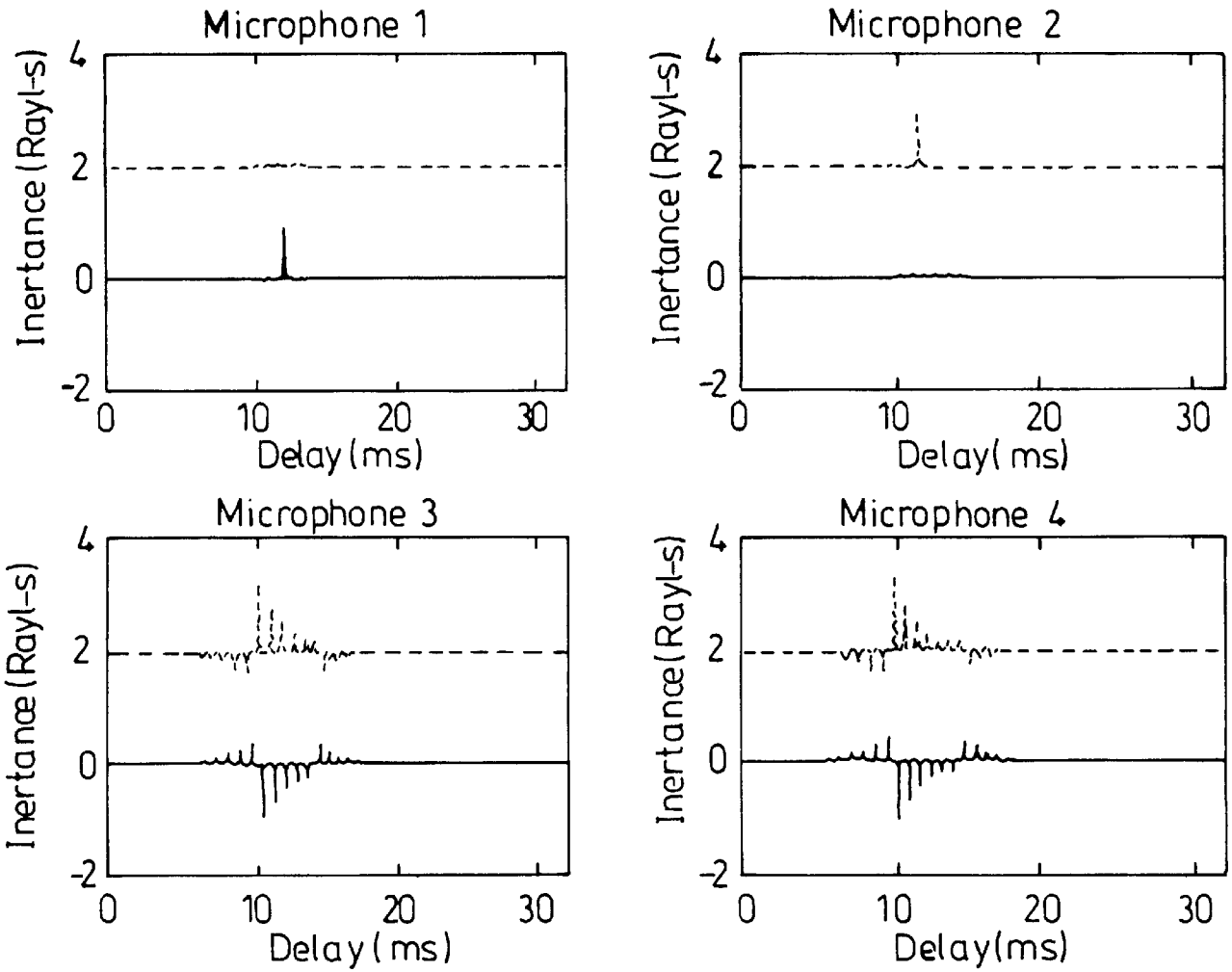
FIG. 13 shows the impulse response of the composite system H(z)C(z) when $x_1$ (solid line) and $x_2$ (dashed line) are filtered by a 2×2 matrix H(z) prior to transmission via sources S1 and S2 in FIG. 10. H(z) is designed to ensure that $x_1$ and $x_2$ are reproduced at M1 and M2 respectively. Note the degradation of the response at M3 and M4.
Figure 14:
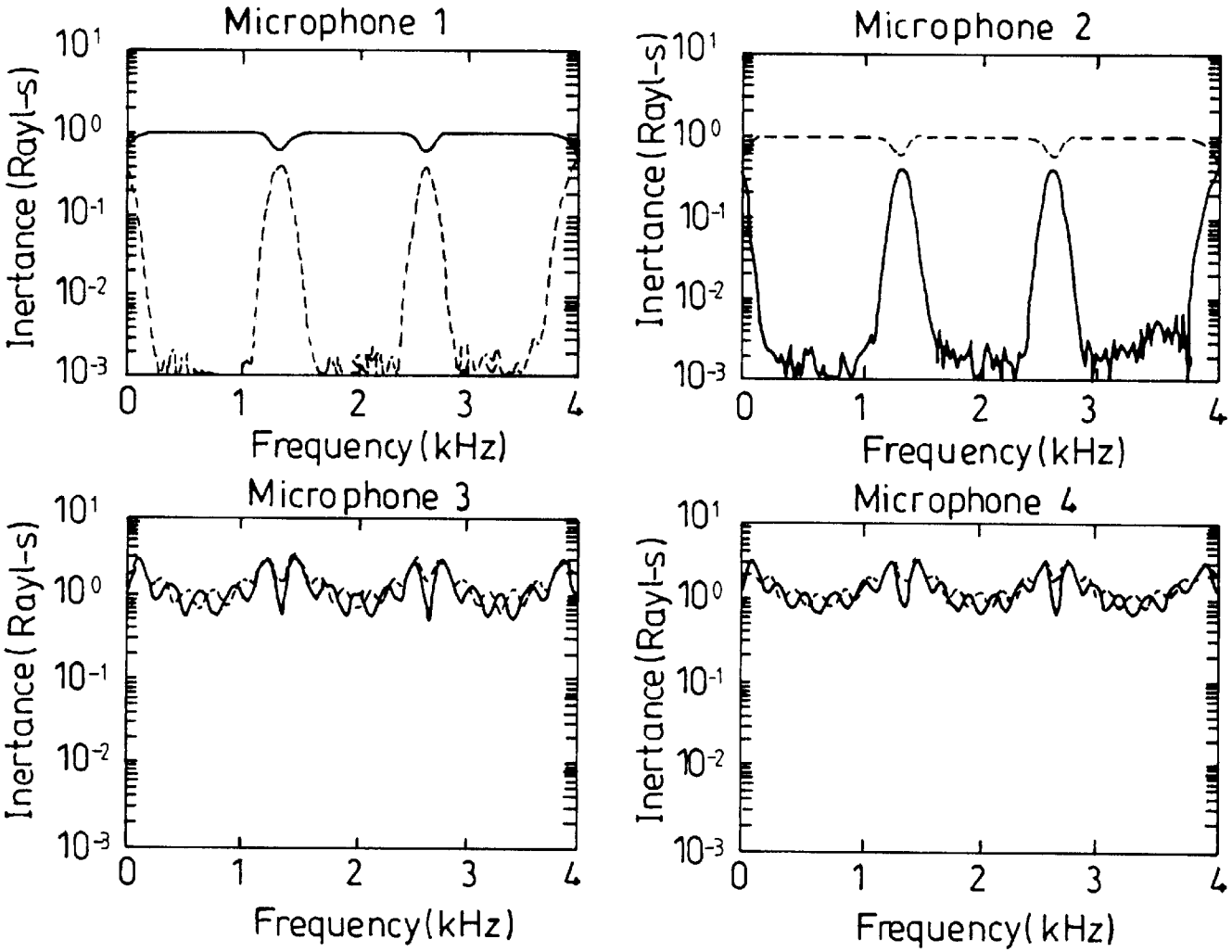
FIG. 14 shows frequency response functions corresponding to the impulse responses of FIG. 13.
Figure 15:
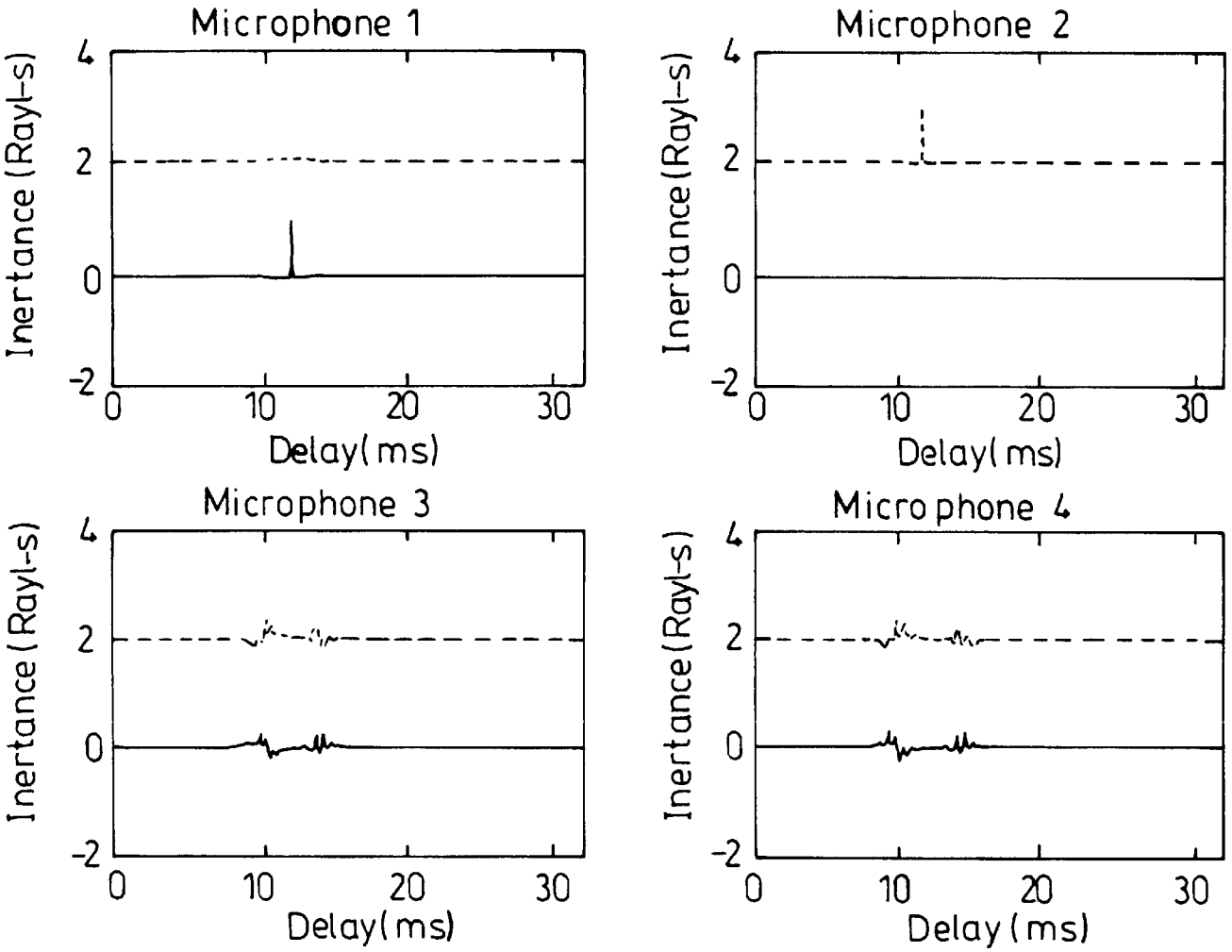
FIG. 15 shows impulse responses of the composite system H(z)C(z) when $x_1$ (solid line) and $x_2$ (dashed line) are filtered by a 4×2 matrix H(z) prior to transmission via all four sources in FIG. 10. H(z) is designed to ensure that $x_1$ and $x_2$ are reproduced at M1 and M2 respectively.
Figure 16:
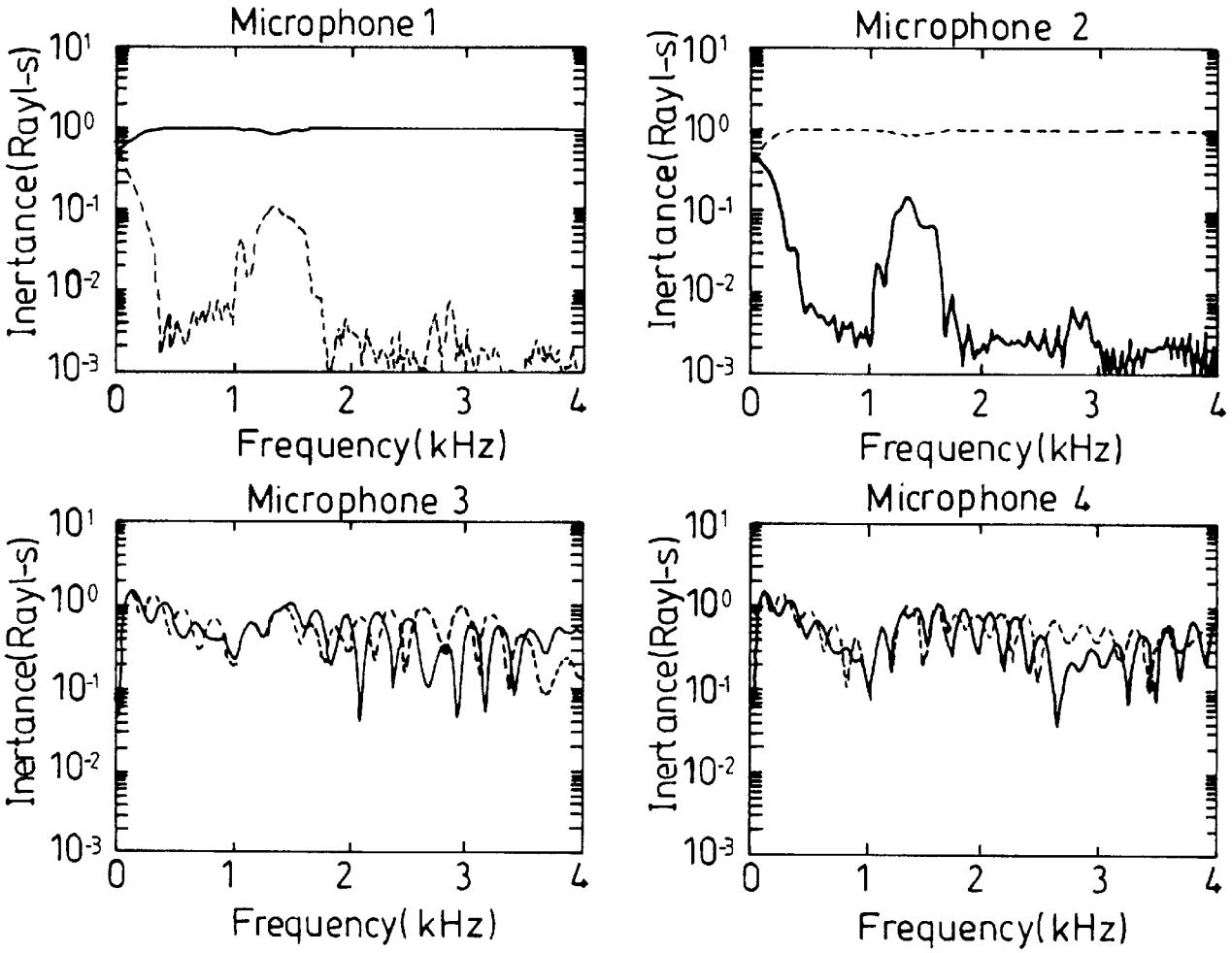
FIG. 16 shows frequency response functions corresponding to the impulse responses of FIG. 15. Note the improvement in cross talk cancellation at M1 and M2 compared to the results of FIG. 14.

The resulting impulse responses of the system consisting of H(z) C(z) are illustrated in FIG. 11 and the corresponding frequency response functions are shown in FIG. 12. A good degree of cross-talk cancellation is clearly evident, although the system becomes less effective at certain frequencies where the inverse filters have difficulty in modelling what amount to poles of the inverse system (see Nelson et al [13] for a fuller discussion). The use of IIR filters may provide a solution to this problem and a preliminary investigation is reported in reference [24]. The use of IIR filters in the single channel case has also been examined by Greenfield and Hawksford [25]. This problem is more clearly illustrated in the simple case of the reproduction of signals $x_1(n)$ and $x_2(n)$ at M1 and M2 respectively. The results of implementing such a system are illustrated in FIGS. 13 and 14. Effective cross-talk cancellation is produced (except at certain frequencies) at microphones 1 and 2, whereas the signals at microphones 3 and 4 are clearly degraded by the operation of the system, as one would expect. Finally, the potential advantages in using more sources than microphones in the sense described in Section 2.3 is illustrated by the results presented in FIGS. 15 and 16. Here, the 4×2 matrix H(z) has been designed to ensure reproduction of $x_1(n)$ and $x_2(n)$ at microphones 1 and 2. Considerably improved cross-talk cancellation can be seen to have been achieved.

SPARSELY UPDATED FILTERS FOR ADAPTIVE DIGITAL PROCESSING OF AUDIO SIGNALS

A sparse update strategy will now be described that allows the implementation of adaptive filters at high sampling rates using existing DSP technology. This technique has the important property that the processing time per sampling period spent in filter update operations is independent of the filter length. Code will be given for both the LMS and the filtered-x LMS algorithms and description of their practical use for loudspeaker equalisation.

INTRODUCTION.

Figure 17:
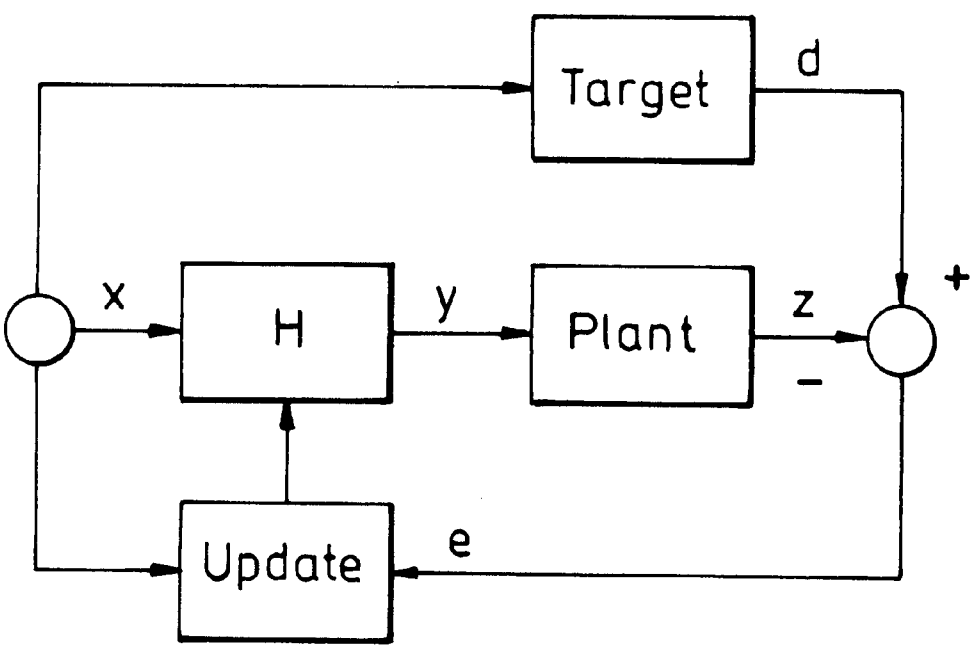
FIG. 17 shows at (a) a block diagram for the adaptive system identification problem. The filter G must be adapted so that its output approximates the output from the plant, and at (b) a block diagram for the adaptive system equalization problem. The filter H must be adapted so that the output from the plant approximates the output of a given target system which, in general, includes a modelling delay that ensures the existence of a causal optimal filter.
Figure 17:
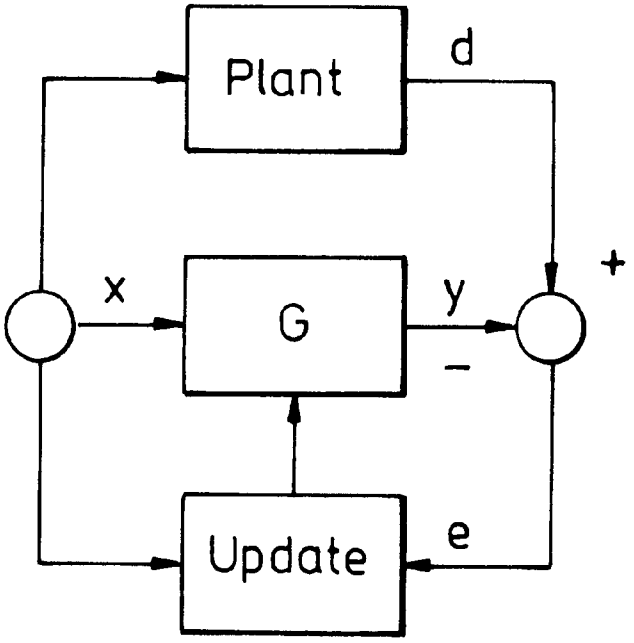

The single-channel system identification problem is shown in FIG. 17(*a*). A vector containing the L most rant samples of the input signal is defined as $$X_n=[X_n x_{n-1} \ldots X_{n-L+1}]^T;$$

similarly a vector containing the coefficents of a (non-stationary) non-recursive digital filter is defined as $$g_n=[g_o(n)g_1(n)\ldots g_{L-1}(n)]^T.$$

The dot product of the input vector with the coefficient vector produces the output $$y_n=g_n^T x_n.$$

This is required to approximate the desired signal $d_n$ (the output from the system under identification), in a way that minimizes the variance of the error signal defined by $$e_n=d_n-y_n.$$

The LMS algorithm [3] performs a stochastic gradient search in L-dimensions according to the formula $$g_{n+1}=g_n+\mu e_n x_n$$

which can be shown to converge on the mean to the exact least mean squares solution of the problem provided the adaptation rate is chosen to satisfy the following condition $$\mu<1/Lo_x^{-2}$$

The implementation of this algorithm in a microprocessor requires 4L arithmetic operations (2L to perform the filtering and 2L to update the filter). At high sampling rates this can prove very taxing and heavy restrictions must be imposed on the number of coefficients.

The system equalization problem is shown in FIG. 17(*b*). In this case, a new filter with coefficients $$h_n=[h_o(n)h_1(n)\ldots h_{L-1}(n)]^T$$

acts on the input signal to produce the signal $$y_n=h_n^T x_n$$

which after transmission through the system produces an output $z_n$ that minimizes the variance of a new error signal defined as $$e_n=d_n-z_n.$$

The coefficients of the optimal filter can be searched using the filtered-x LMS algorithm [9]

$$h_{n+1}=h_n+\mu e_n r_n;$$

where the vector $r_n$, containing recent samples of the reference signal $$r_n=g^T x_n,$$

is used instead of the vector of input signals as in the LMS algorithm. This increases the arithmetic work by another 2L operations (assuming that both filters g and h have the same length). The arithmetic work thus increases to 6L operations.

SPARSE UPDATE IMPLEMENTATION OF THE LMS ALGORITHM.

One way of reducing the operation count required to update the filter coefficients using the LMS algorithm is to devise a criterion to select the absolute minimum number of operations that are still necessary to maintain the convergence properties of the algorithm. The minimum work that can be done is to update only one filter coefficient per sampling period. This can be implemented by performing the following operations at every processing cycle n $g_k(n)=g_k(n)+\mu e_n x_{n-k}$, (update current filter tap)

k=(k+1)mod L; (increment tap counter)

where k is a counter set initially to k=0 that runs circularly along the vector of filter coefficients. Note that because n and k are always incremented by 1 every cycle (except when k wraps around to zero), the input sample that is used for the update $x_{k-n}$ is exactly the same during the L cycles that it takes to perform one pass along the whole filter. This observation leads to the following alternative, but exactly equivalent, version of the sparse update version of the LMS algorithm if k=0 then $\alpha=\mu x_n$ (store, and pre-multiply, input sample)

$g_k(n)=g_k(n)+\alpha e_n$ (update current filter tap)

k=(k+1)mod L (increment tap counter)

By following any of these procedures, it takes L processing cycles to update the whole filter, but the operation count is reduced to 2L (basically those involved in the actual filtering).

SPARSE UPDATE IMPLEMENTATION OF THE FILTERED-X LMS ALGORITHM

A sparse update implementation of the filtered-x LMS algorithm presents the additional challenge of having to calculate the filtered reference signal in a way which is compatible with the sparse update of the filter coefficients. Interestingly enough the calculation of the filtered reference signal can be performed also on a single-tap basis as follows if k=0 then r=0 (clear filtered-x accumulator)

$r=r+g_{L-k-1}x_n$ (accumulate current product)

if k=L−1 then $\alpha=\mu r$ (when done, store filtered-x)

k=(k+1)mod L (increment tap counter)

$h_k(n)=h_k(n)+\alpha e_n$ (update current filter tap)

Note that the calculation of the next sample of the filtered reference signal starts L cycles in advance. To this end, the coefficients of the reference filter g are accessed in reverse, as shown, and the filtering makes use of the most recent input sample at every cycle (which, as it were, gets old by itself as times goes by). The operation count reduces again to just over 2L as in the sparse update implementation of the LMS algorithm.

LOUDSPEAKER EQUALIZATION USING SPARSE UPDATE ADAPTIVE FILTERS.

Figure 18:
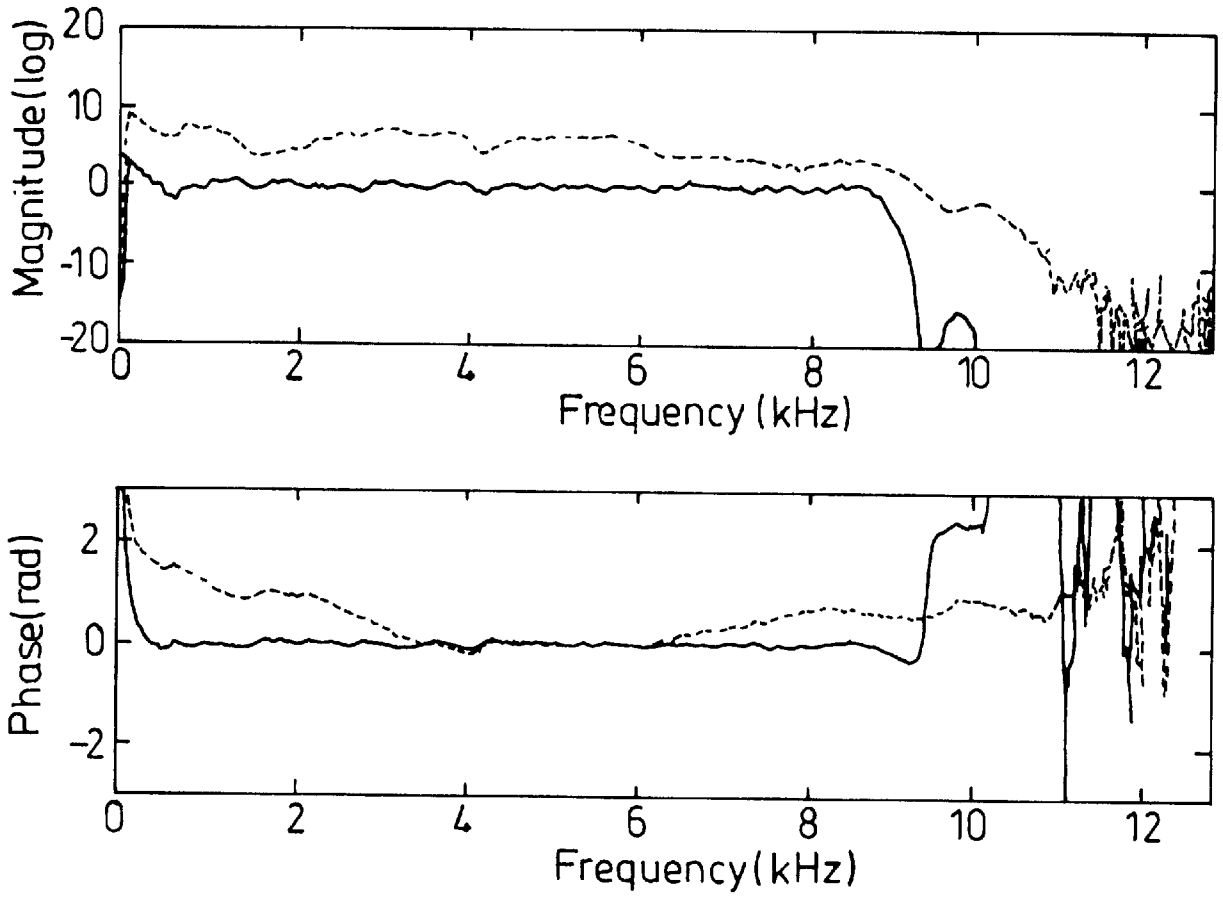
FIG. 18 shows the frequency response function of a loudspeaker in an anechoic chamber. Unequalized (dashed line) and equalized using in accordance with the invention the sparse update adaptive algorithms (solid line).

FIG. 18 shows the frequency response function of a loudspeaker in an anechoic chamber equalized to obtain a flat magnitude response and a linear phase response. The processing was performed in floating point arithmetic using a Texas Instruments TMS320C30 processor. The sampling frequency was set to f=32 kHz and the filter length to L=48. The impulse response function of the system was first identified using the sparse update version of the LMS algorithm. The system was later equalized using the sparse update implementation of the filtered-x LMS algorithm (A full update could only be possible at f=16 kHz or L=24.)

REFERENCES

1. Wiener, N. (1949). *Extrapolation, Interpolation and Smoothing of Stationary Time Series*. John Wiley, New York.
2. Widrow, B. and Hoff, M. (1960). Adaptive switching circuits. *Proceedings IRE WESCON Convention Record*, Part 4, Session 16, pp. 96–104.
3. Widrow, B. and Stearns, S. D. (1985). *Adaptive Signal Processing*. Prentice Hall, Englewood Cliffs, N.J.
4. Morgan, D. R. (1980). An analysis of multiple correlation cancellation loops with a filter in the auxiliary path.

*Institute of Electrical and Electronics Engineers Transactions on Acoustics, Speech and Signal Processing* ASSP-28, 454–467.

5. Widrow, B., Shur, D. and Shaffer, S. (1981). On adaptive inverse control. *Proceedings of the 15th ASILOMAR Conference on Circuits, Systems and Computers*, pp. 185–195.
6. Burgess, J. C. (1981). Active adaptive sound control in a duct: a computer simulation. *Journal of the Acoustical Society of America* 70, 715–7626.
7. Nelson, P. A., Curtis, A. R. D. and Elliott, S. J. (1985). Quadratic optimisation problems in the active control of free and enclosed sound fields. *Proceedings of the Institute of Acoustics* 7, 45–53.
8. Elliott, S. J. and Nelson, P. A. (1985a). Algorithm for multi-channel LMS adaptive filtering. *Electronics Letters* 21, 979–981.
9. Elliott, S. J., Stothers, I. M. and Nelson, P. A. (1987a). A multiple error LMS algorithm and its application to the active control of sound and vibration. *Institute of Electrical and Electronics Engineers Transactions on Acoustics Speech and Signal Processing* ASSP-35, 1423–1434.
10. Nelson, P. A. and Elliott, S. J. (1992). *Active Control of Sound*. Academic Press, London.
11. Nelson, P. A. and Elliott, S. J. and Stothers, I. M. (1988). Improvements in or relating to sound reproduction systems. International Patent Application PCT/GB89/00773.
12. Nelson, P. A. and Elliott, S. J. (1988). Least squares approximations to exact multiple point sound reproduction. *Proceedings of the Institute of Acoustics* 10, 151–168.
13. Nelson, P. A., Hamada, H. and Elliott, S. J. (1992). Adaptive inverse filters for stereophonic sound reproduction. *Institute of Electrical and Electronics Engineers Transactions on Signal Processing* Vol .40, No. 7.
14. Robinson, E. A. (1978). *Multi-channel Time Series Analysis with Digital Computer Programs* (revised edition). Holden Day, San Francisco.
15. Miyoshi, M. and Kaneda, Y. (1988a). Inverse filtering of room acoustics. *Institute of Electrical and Electronics Engineers Transactions on Acoustics, Speech and Signal Processing* ASSP-36, 145–152.
16. Nelson, P. A., Hamada, H. and Elliott, S. J. (1991a). Inverse filters for multichannel sound reproduction. Paper presented to the *Japanese Institute of Electronics, Information and Communication Engineers*, April 1991, Tokyo Denki University.
17. Kuriyama, J. and Furukawa, Y. (1988). Adaptive loudspeaker system. Paper presented at the 85th *Convention of the Audio Engineering Society*, Los Angeles.
18. Wilson, R. (1989). Equalization of loudspeaker drive units considering both on-and off-axis responses. Paper presented at the 86th *Convention of the Audio Engineering Society*, Hamburg.
19. Farnsworth, K. D., Nelson, P. A. and Elliott, S. J. (1985). Equalisation of room acoustic responses are spatially distributed regions. *Proceedings of the Institute of Acoustics Autumn Conference, Reproduced Sound*, Windermere.
20. Elliott, S. J. and Nelson, P. A. (1988). Multiple point least squares equalisation in a room using adaptive digital filters. *Journal of the Audio Engineering Society* 37, 899–907.
21. Atal, B. S. and schroeder, M. R. (1962). Apparent sound source translator.
U.S. Pat. No. 3,236,949.
22. Schroeder, M. R. (1975). Models of hearing. *Proceedings of the IEEE*, 63 1332–1352.
23. Orduna-Bustamante, F., Nelson, P. A., Hamada, H. and Uto, S. (1992).
Computer simulation of a stereo sound reproduction system with adaptive cross-talk cancellation. *Proceedings of the first international conference on motion and vibration control*, Yokohama, Japan.
24. Nakaji, Y. and Nelson, P. A. (1992). Equation error adaptive IIR filters for single channel response equalisation. *ISVR Technical Memorandum No.* 713.
25. Greenfield, R. and Hawksford, M. O. (1991). Efficient filter design for loudspeaker equalisation. *Journal of the Audio Engineering Society* 39, 739–751.

What we claim is:

1. A sound reproduction system comprising:

a plurality of loudspeakers (S1, S2) spaced from a listener at a location (M1, M2);

loudspeaker drive means (H) for driving the loudspeakers (S1, S2) in response to a plurality of channels of a sound recording (x) of the type being suitable for playing normally through a plurality of reference speakers that are optimally positioned at locations that are displaced from the actual positions of the loudspeakers (S1, S2), wherein the loudspeaker drive means includes a digital filter means (H), having a filter characteristic selected by minimising the difference between a desired sound field that would be created by playing the unfiltered sound recording (x) through the reference speakers and a sound field reproduced at the listener location (M1, M2) by playing the recording through the speakers (S1, S2) in order to create a local sound field at the listener location (M1, M2) which is substantially equivalent to the local field that would result from playing the unfiltered sound recording (x) through the reference speakers, the digital filter means (H) being designed by a filter design process in which the filter coefficients which determine said filter characteristics of the digital filter means (H) are designed so as to approximately reproduce in the sound field the desired signals (d) which are specified by the use of a filter matrix (A) used to relate the desired signals (d) of said desired sound field to recorded signals (x).

2. A sound reproduction system as claimed in claim 1, wherein, in use, the actual positions of the loudspeakers (S1, S2) are predetermined positions that are asymmetric with respect to the listener location (M1, M2).

3. A sound reproduction system as claimed in claim 1, wherein the actual positions of the loudspeakers (S1, S2) are predetermined positions that are more narrowly spaced from each other than the spacing of the reference speakers.

4. A sound reproduction system comprising:

a plurality of loudspeakers (S1, S2) spaced from a listener at a location (M1, M2);

loudspeaker drive means (H) for driving the loudspeakers (S1, S2) in response to a plurality of channels of a sound recording (x) of the type being suitable for playing normally through a plurality of reference speakers that are optimally positioned at locations that are displaced from the actual positions of the loudspeakers (S1, S2), wherein the loudspeaker drive means includes a digital filter means (H), having a filter characteristic selected by minimising the difference between the time history of a desired sound field that would be created by playing the unfiltered sound recording (x) through the reference speakers and the time history of the sound field reproduced at the listener location (M1, M2) by playing the recording through the speakers (S1, S2) in order to create a local sound field at the listener location (M1, M2) which is substantially equivalent to the local field that would result from playing the unfiltered sound recording (x) through the reference speakers, the digital filter means (H) being designed by a filter design process in which the filter coefficients which determine said filter characteristics of the digital filter means (H) are designed so as to approximately reproduce in the sound field the desired signals (d) which are specified by the use of a filter matrix (A) used to relate the desired signals (d) of said desired sound field to recorded signals (x).

5. A sound reproduction system as claimed in claim 4, wherein, in use, the actual positions of the loudspeakers (S1, S2) are predetermined positions that are asymmetric with respect to the listener location (M1, M2).

6. A sound reproduction system as claimed in claim 4, wherein the actual positions of the loudspeakers (S1, S2) are predetermined positions that are more narrowly spaced from each other than the spacing of the reference speakers.

7. A sound reproduction system comprising:

a set of four loudspeakers (S1, S2, S3, S4) which are arranged in use at spaced-apart positions to create a sound field at a first and second predetermined listener locations (M1, M2, M3, M4), within the sound field;

a digital filter means (H) through which the loudspeakers are driven by two channels ($x_1$, $x_2$) of a sound recording, the filter means (H) having a filter characteristic selected by minimising an error between a desired sound field that would be created by playing unfiltered channels of the sound recording through a set of reference speakers that are optimally positioned at a location generally symmetric to the first and second predetermined listener locations and a reproduced sound field created by playing the channels of the sound recording through the set of four loudspeakers (S1, S2, S3, S4) in order to create at both the first and second listener locations (M1, M2), (M3, M4) a respective local portion of the sound field which is substantially the same as the sound field portion that would be produced by the reference speakers, the digital filter means (H) being designed by a filter design process in which the filter coefficients which determine said filter characteristics of the digital filter means (H) are designed so as to approximately reproduce in the sound field the desired signals (d) which are specified by the use of a filter matrix (A) used to relate the desired signals (d) of said desired sound field to recorded signals (x).

* * * * *

UNITED STATES PATENT AND TRADEMARK OFFICE

CERTIFICATE OF CORRECTION

PATENT NO. : 5,949,894

DATED : September 7, 1999

INVENTOR(S) : P.A. Nelson et al.

It is certified that error appears in the above-identified patent and that said Letters Patent is hereby corrected as shown below:

| COLUMN | LINE | ERROR |
|---|---|---|
| Pg. 1, col. 1 | Refs. Cited, U.S. Patents | Please insert the following in appropriate numerical order among the U.S. patents: |

| | | |
|---|---|---|
| --3,236,949 | 02/1966 | Atal et al. |
| 5,068,897 | 11/26/91 | Yamato |
| 5,305,386 | 04/19/1994 | Yamato-- |

| | | |
|---|---|---|
| Pg. 1, col. 2 | Refs. Cited | After the final U.S. patent, please insert |

--FOREIGN PATENT DOCUMENTS

| | | |
|---|---|---|
| 5,585,190 | 06/26/80 | Japan |

OTHER PUBLICATIONS

P.A. Nelson et al., "Quadratic Optimisation Problems in the Active Control of Free and Enclosed Sound Fields," *Proceedings of the Institute of Acoustics,* 7(2):45-53 (1985).

S.J. Elliott et al., "Algorithm for Multichannel LMS Adaptive Filtering," *Electronics Letters,* 21:979-981 (October 1985).

UNITED STATES PATENT AND TRADEMARK OFFICE

CERTIFICATE OF CORRECTION

PATENT NO. : 5,949,894
DATED : September 7, 1999
INVENTOR(S) : P.A. Nelson et al.

It is certified that error appears in the above-identified patent and that said Letters Patent is hereby corrected as shown below:

(Continued)

S.J. Elliott et al., "A Multiple Error LMS Algorithm and Its Application to the Active Control of Sound and Vibration," *IEEE Transactions on Acoustics, Speech, and Signal Processing*, ASSP-35(10):1423-1434 (October 1987).

P.A. Nelson et al., "Least Squares Approximations to Exact Multiple Point Sound Reproductions," *Proceedings of the Institute of Acoustics*, 10:151-168 (1988).

P.A. Nelson et al., "Adaptive Inverse Filters for Stereophonic Sound Reproduction," *IEEE Transactions on Signal Processing*, 40:1621-1632 (July 1992).

M. Miyoshi et al., "Inverse Filtering of Room Acoustics," *IEEE Transactions on Acoustics, Speech, and Signal Processing*, 36:145-152 (February 1988).

P.A. Nelson et al., "Inverse Filters for Multi-Channel Sound Reproduction," E A 91-2:11-25 (April 1991).

UNITED STATES PATENT AND TRADEMARK OFFICE

CERTIFICATE OF CORRECTION

PATENT NO. : 5,949,894

DATED : September 7, 1999

INVENTOR(S) : P.A. Nelson et al.

It is certified that error appears in the above-identified patent and that said Letters Patent is hereby corrected as shown below:

(Continued)

J. Kuriyama et al., "Adaptive Loudspeaker System," *AES 85th Convention, Los Angeles* (November 3-6, 1988)

R. Wilson, "Equalization of Loudspeaker Drive Units Considering Both On- and Off-Axis Responses," *AES 86th Convention, Hamburg* (March 7-10, 1989).

K.D. Farnsworth et al., "Equalisation of Room Acoustic Responses Over Spatially Distributed Regions." *Institute of Sound and Vibration Research.*

S.J. Elliott et al., "Multiple-Point Equalization in a Room Using Adaptive Digital Filters," *J. Audio Eng. Soc.*, 37(11):899-907 (November 1989).

F. Orduña-Bustamante et al., "Computer Stimulation of a Stereo Sound Reproduction System With Adaptive Cross-Talk Cancellation." *Institute of Sound and Vibration Research.*

Y. Nakaji et al., "Equation Error Adaptive IIR Filters for Single Channel Response Equalization," *ISVR*, Technical Memorandum No. 712, (February 1992).

UNITED STATES PATENT AND TRADEMARK OFFICE

CERTIFICATE OF CORRECTION

PATENT NO. : 5,949,894

DATED : September 7, 1999

INVENTOR(S) : P.A. Nelson et al.

It is certified that error appears in the above-identified patent and that said Letters Patent is hereby corrected as shown below:

(Continued)

R. Greenfield et al., "Efficient Filter Design for Loudspeaker Equalization," *J. Audio Eng. Soc.*, 39(10):739-751 (October 1991).--

Signed and Sealed this

Twenty-second Day of August, 2000

*Attest:*

Q. TODD DICKINSON

*Attesting Officer*

*Director of Patents and Trademarks*